US005322091A

United States Patent [19]

Marelin

[11] Patent Number: 5,322,091

[45] Date of Patent: Jun. 21, 1994

[54] LOCK BETWEEN BAND AND BUCKLE OF BAND CLAMP

[75] Inventor: Miklos B. Marelin, Aurora, Colo.

[73] Assignee: Band-It-Idex, Inc., Denver, Colo.

[21] Appl. No.: 908,983

[22] Filed: Jul. 6, 1992

Related U.S. Application Data

[63] Continuation-in-part of Ser. No. 594,377, Oct. 5, 1990, Pat. No. 5,127,446.

[51] Int. Cl.[5] ..... B21F 9/02

[52] U.S. Cl. ..... 140/93.4; 140/152

[58] Field of Search ..... 140/93.4, 150, 152; 24/202, 20 EE, 20 LW, 20 TT, 23 B; 403/274, 282, 279, 373; 285/382, 256, 257

[56] References Cited

U.S. PATENT DOCUMENTS

| | | | |
|---|---|---|---|
| 356,083 | 1/1887 | Schrader et al. . | |
| 997,186 | 7/1911 | Flora . | |
| 1,000,083 | 8/1911 | Flora . | |
| 1,649,363 | 11/1927 | Parsons | 140/152 |
| 1,670,201 | 5/1928 | McGary | 140/152 |
| 2,075,720 | 3/1937 | Hoffman | 140/93.4 |
| 2,118,158 | 5/1938 | Carlson | 24/23 |
| 2,214,110 | 9/1940 | Ott | 140/152 |
| 2,928,434 | 3/1960 | McAneny | 140/43.4 |
| 3,067,640 | 12/1962 | Lodholm | 81/9.3 |
| 3,344,815 | 10/1967 | Lawson et al. | 140/123.6 |
| 4,056,128 | 11/1977 | Konrad | 140/93.4 |
| 4,333,210 | 6/1982 | Burnett | 24/30.5 |
| 4,646,393 | 3/1987 | Young | 24/20 R |
| 4,696,327 | 9/1987 | Wolcott | 140/150 |
| 4,896,402 | 1/1990 | Jansen et al. | 24/20 R |
| 4,928,738 | 5/1990 | Marelin et al. | 140/93.4 |
| 4,934,416 | 7/1990 | Tonkiss | 140/152 |
| 5,000,232 | 3/1991 | Wolcott | 140/93.4 |
| 5,007,465 | 4/1991 | Tonkiss | 140/93.4 |

*Primary Examiner*—Lowell A. Larson

*Attorney, Agent, or Firm*—Sheridan Ross & McIntosh

[57] ABSTRACT

The present invention provides a band clamp with an improved lock between the band and the buckle of the band clamp. The improved lock is of the type of lock where the band is passed through the buckle and then shaped to form a locking surface that engages the exterior of the buckle to prevent the band from being pulled back through the buckle. Characteristic of the improved lock is that the lateral cross-section of the locking surface is, in one embodiment substantially V-shaped. In other embodiments, the lateral cross-section is substantially U-shaped and substantially Ω-shaped.

15 Claims, 17 Drawing Sheets

LOCK BETWEEN BAND AND BUCKLE OF BAND CLAMP

CROSS-REFERENCE TO RELATED APPLICATION

This application is a continuation-in-part application of prior application Ser. No. 07/594,377, filed Oct. 5, 1990, now U.S. Pat. No. 5,127,446 granted Jul. 7, 1992.

TECHNICAL FIELD OF THE INVENTION

This invention relates in general to securing a band to a buckle of a band clamp, and in particular to an improved lock between a band and a buckle as well as an apparatus and method for forming the improved lock.

BACKGROUND OF THE INVENTION

The use of a hand tool to tighten a band clamp has long been known. Band clamps are typically used to secure bundles of materials together and to secure pipes, wiring, etc. In one such application, a band clamp is applied to secure a protective metal braiding around a bundle of wiring which is connected to a plug or coupler known as a back shell.

Back shells are frequently used in military and aerospace applications where wiring carrying low voltage signals are conducted. Both the cables and the connectors must be protectively covered with a metallic substance to limit the harmful effects of radiation thereon. This metallic shielding must be without any "windows" (openings) and must in all parts have a ground connection with only low resistance to effectively minimize any electrical potential this "shielding" system may receive due to external or internal electromagnetic radiation (such as radio emission, cosmic rays, lightning strike, explosion of an atomic device, etc.). The diameter of the back shell body is typically larger than the diameter of the cable entering thereinto, and in order to have a satisfactory interconnection, a banding tool must be capable of applying a band clamp proximate the intersection of the back shell body and the cable entry stem. Thus the banding tool should be approximately the same width as the band clamp to be applied and should be capable of applying the band clamp from any direction.

One tool for tightening band clamps to a back shell is disclosed in U.S. Pat. No. 4,726,403, to Young et al., Feb. 23, 1988. The Young et al. device uses a toggle arrangement to tension the band clamp in place. Upon reaching the appropriate tension in the band clamp, the tool locks in a closed condition. To sever the tail from the tightened band clamp, a cutting arm must be rotated outwardly and upwardly from the side of the banding tool.

Due to the externally attached cutting device, the Young et al. banding tool is capable of applying a band clamp close to the back shell from only one direction. If a band is attempted to be connected from the opposite direction, the cutting device may prevent proper installation. The Young et al. tool is therefore limited in its application and becomes difficult to operate in confined spaces such as are found in aircraft fuselages.

Additionally, Young's tool uses toggles to transfer tension and toggles generally have a short power stroke in order to make the tool usable by an average person. Therefore, a larger size tool is required to sufficiently tension the band.

Another banding tool is disclosed in U.S. Pat. No. 4,928,738 to Marelin et al., May 29, 1990, assigned to the same assignee as the present invention. The '738 tool uses toggles to provide the power stroke and counteracting springs to achieve the desired tension in a band. It is necessary to force the band to bend around internal portions of the tool during tensioning. Additionally, the tool is not designed with overall width as a primary consideration.

Still another banding tool is disclosed in U.S. Pat. No. 2,087,655 to Prestwich, Jul. 20, 1937, the '655 device has a gripper section which holds one end of the band to be tensioned while a tensioning section grips and pull the other end of the band. The tensioning section comprises a double set of knurled wheels with a first set fixed and a second set movable. While the first set prevents slippage of the band, the second set tensions the band. While there is an angle between the tensioning section and the gripper section, this angular relationship does not provide the advantages of the present invention. Thus there is a need for a method and apparatus to allow tensioning of a band clamp to a back shell from either direction.

An additional concern is the lock established between the band and the buckle of a band clamp. Particularly, the type of lock that is of concern is one in which the free end of a band, whose other end is operatively attached to a buckle, is wrapped about an object and inserted through a passageway extending through the buckle and then bent to create a surface which engages the exterior of the buckle preventing the band from pulling back through. The lock itself is defined by the engagement of the band to the exterior of the buckle. For example, in one lock of this type known to those skilled in the art, the lock is formed by bending the band transverse to the length of the band and away from the object about which the band clamp is wrapped to create the surface, a lip, which engages the upper exterior surface of the buckle to lock the band in place.

The known locks of the type that are formed by bending the band to create a surface that engages the exterior surface of the buckle suffer from many deficiencies and inadequacies. Particularly, a problem prevalent among known locks of this type is their lack of holding power in certain circumstances. One such circumstance is when the lock is used to secure a band clamp about an object which is capable of expansion and contraction. In this situation, the known locks of the aforementioned type are susceptible to failure upon expansion of the object. Consequently, there is a need for a lock of the aforementioned type that exhibits improved strength in these and like circumstances.

A further problem of known locks of the stated type is the force required of the banding tool to create the lock. In many instances, the force necessary to create the locks necessitates the use of a power tool or if a hand tool is employed, considerable force must typically be applied by the operator. For example, in the lock in which the band is bent transverse to its longitudinal axis and away from the object about which the band clamp is wrapped, the devices presently used to shear off the excess band make the entire cut at one time. Further, the force necessary to make the entire cut at once increases as the width of the band increases and as the thickness of the band increases. However, the use of a power tool is not practical in many applications. Similarly, in many situations it is not possible for an operator to apply the requisite force to a hand tool. Consequently, there is a further need for a lock that can be readily formed with hand banding tools.

An additional problem in the aforementioned type of lock is its susceptibility to snagging. Specifically, the known locks of this type are formed in a manner in which they are susceptible to failure due to edges of the lock snagging on articles that can destroy the lock between the band and the buckle by "unbending" the band. For example, the lock formed by bending the band transverse to its longitudinal axis typically has an exposed edge where the excess band has been sheared that is readily snagged. Further, the snagged edge of the lock may damage the material or object that has been snagged. As is apparent, there is a further need for a lock of the defined type that is less susceptible to snagging.

A further problem in the known locks of the aforementioned type is their susceptibility to tampering. For example, the known lock in which the edge of the band is bent away from the object about which the band is wrapped can be defeated with simple tools, such as a pair of pliers, and by hand in some instances. Therefore, there is an additional need for a lock of the defined type that is less susceptible to tampering.

A further problem for locks of the aforementioned type, and especially those in which the band is bent transverse to the length of the band to create a lip that engages the upper exterior surface of the buckle, is that the tool which is used to create the lock and the clamped object must be rotated relative to one another to form the lip. During this rotation process, it is necessary to release some of the tension in the band to prevent the portion where the lock is to be established from thinning or breaking. Hence there is a need for a lock that can be formed while substantially avoiding having to release tension in the band, relative rotation between the band and the clamped object, or thinning of the band in the lock area due to rotation. Concomitantly, there is a need for a tool for forming such a lock.

A further problem of the known locks of the aforementioned type is the inability of one banding tool to create the locks with various widths of the band. Consequently, a separate banding tool must be acquired for each width of band and associated buckle that is employed. Hence, there is a need for a lock that can be formed in band clamps of varying widths by one banding tool.

An additional problem of the known locks is their relative short life. Band clamps are often used in circumstances where they are unprotected from various elements, including the weather, and under great force. In these circumstances, the formation of known locks do not provide the long-life characteristics desired.

A further problem of the known locks is the difficulty in forming a proper lock in circumstances wherein the bundle or object sought to be secured is, for example, at a remote location. The known locks are inadequately designed to be formed by hand-held tools as opposed to machine tools, due to the forces required to form the lock.

Based on the foregoing, there exists a need for an improved lock for a band clamp that is of the type in which the band is bent to form a surface that engages the exterior surface of the buckle and method for making same that exhibits improved strength characteristics. Among other things, there exists a need for a lock of this type that exhibits improved strength characteristics, that can be readily made with hand tools as well as mechanized tools, that is less susceptible to snagging, that is tamper resistant, that permits a single tool to be used to create a lock in band clamps of different widths, and that can be formed while substantially avoiding the release of any tension in the band, relative rotation in the band, rotation between the band and the clamped object, or thinning of the buckle. Moreover, there is a need for a tool and method for forming such a lock.

SUMMARY OF THE INVENTION

The present invention disclosed herein comprises a method and apparatus for a banding tool using a force storing device which substantially eliminates or reduces problems associated with prior banding tools. The present invention allows the installation of a band to a coupling in which the tool must be placed proximate the coupling from either side thereof.

In accordance with one aspect of the invention, a tool for tensioning a band is provided. The tool comprises a tensioning means having a first longitudinal axis therethrough. Means for transferring tension from the tensioning means to the band is interconnected to the tensioning means at an angle thereto.

The tensioning means comprises a force storing device within a hollow handle of the tool. A tension adjustment plunger, a tension adjustment screw and a connecting rod are interconnected to the force storing device and the means for transferring tension. In a preferred embodiment the force storing device comprises a compression spring which is precompressed a desired amount by the adjustment plunger.

The means for transferring tension comprises a tension transfer lever interconnected to the tensioning means and a tensioning block. At least one push link is connected on a first end thereof to the tensioning means and on a second end to the lever arm. A tension block having an elongated slot and a tension pin therein is connected to the lever arm, wherein the tension block pulls the band into tension.

It is a technical advantage of the present invention that a band may be tensioned around a back shell from either direction. It is a further advantage of the present invention that a precompressed spring is used for achieving a desired tension in the band. It is a still further advantage of the present invention that levers are used to transfer tension rather than toggles resulting in a more work efficient tool.

The present invention disclosed herein further comprises a band clamp with an improved lock of the type in which the band is bent to create a surface that engages an exterior surface of the buckle and method for making such an improved lock which addresses the problems associated with known locks of this type. Accordingly, the present invention provides a lock that is formed by engaging the band with the buckle in a manner to increase the strength of the resulting lock. This is accomplished, at least in part, by bending the band along a line that is other than transverse to the passageway of the buckle or to the longitudinal axis of the band to establish the surface which engages the exterior of the buckle in contradistinction to the known locks of this type. This way of forming the lock contributes to the ability of the lock to withstand greater forces.

In accordance with one embodiment of the invention, the edges of the band are bent to form a locking surface with a substantially V-shaped transverse cross-section for engaging an external portion of the buckle. Further, the end of the band is cut in a manner that does not require a cutting edge to make the entire cut at one time. In one embodiment, this is achieved by cutting the band along a curve. Formed in this way, the lock can be readily formed by a hand banding tool as well as a powered banding tool.

In accordance with another embodiment of the invention, the edges of the band are bent to form a surface for engaging the exterior of the buckle that has a substantially "U" shaped transverse cross-section. Formed this way, in order for the lock to fail, the edges engaging the exterior of the buckle must be defeated along their entire length. As consequence, the instant invention provides a strong and generally long-lasting lock.

In accordance with a further embodiment of the invention, a portion of the band located intermediate to the lateral edges of the band is bent substantially parallel to the passageway of the buckle to create the surface that engages the exterior of the buckle to form a lock. Stated another way, the band is bent in a manner that produces a substantially Ω-shaped transverse cross-section. Formed in this way, the exposed edges are reduced thereby reducing the chances that the integrity of the lock will be compromised.

In a further embodiment of the invention, a lock cover is added to the upper portion of the buckle to protect the aforementioned Ω-shaped lock against tampering. Further, the lock cover and lock permit a banding tool to be designed that can be used to form the lock with bands and buckles of various widths.

Based on the foregoing, the present invention provides a lock which is able to withstand greater forces, and in various embodiments is long lasting, less susceptible to snagging or tampering, able to be easily formed, and can be formed while substantially avoiding the release of tension in the band, relative rotation between the band and the clamped object, or thinning of the band in the regions of the lock due to this rotation. The present invention, in at least one embodiment, provides a lock so that a banding tool can be designed to accommodate band clamps of various widths. Furthermore, the present invention provides a tool and a method for forming such a lock.

BRIEF DESCRIPTION OF THE DRAWINGS

For a more complete understanding of the present invention and for further advantages thereof, reference is now made to the following detailed description taken in conjunction with the accompanying drawings, in which.

DETAILED DESCRIPTION OF THE INVENTION

Figure 1:
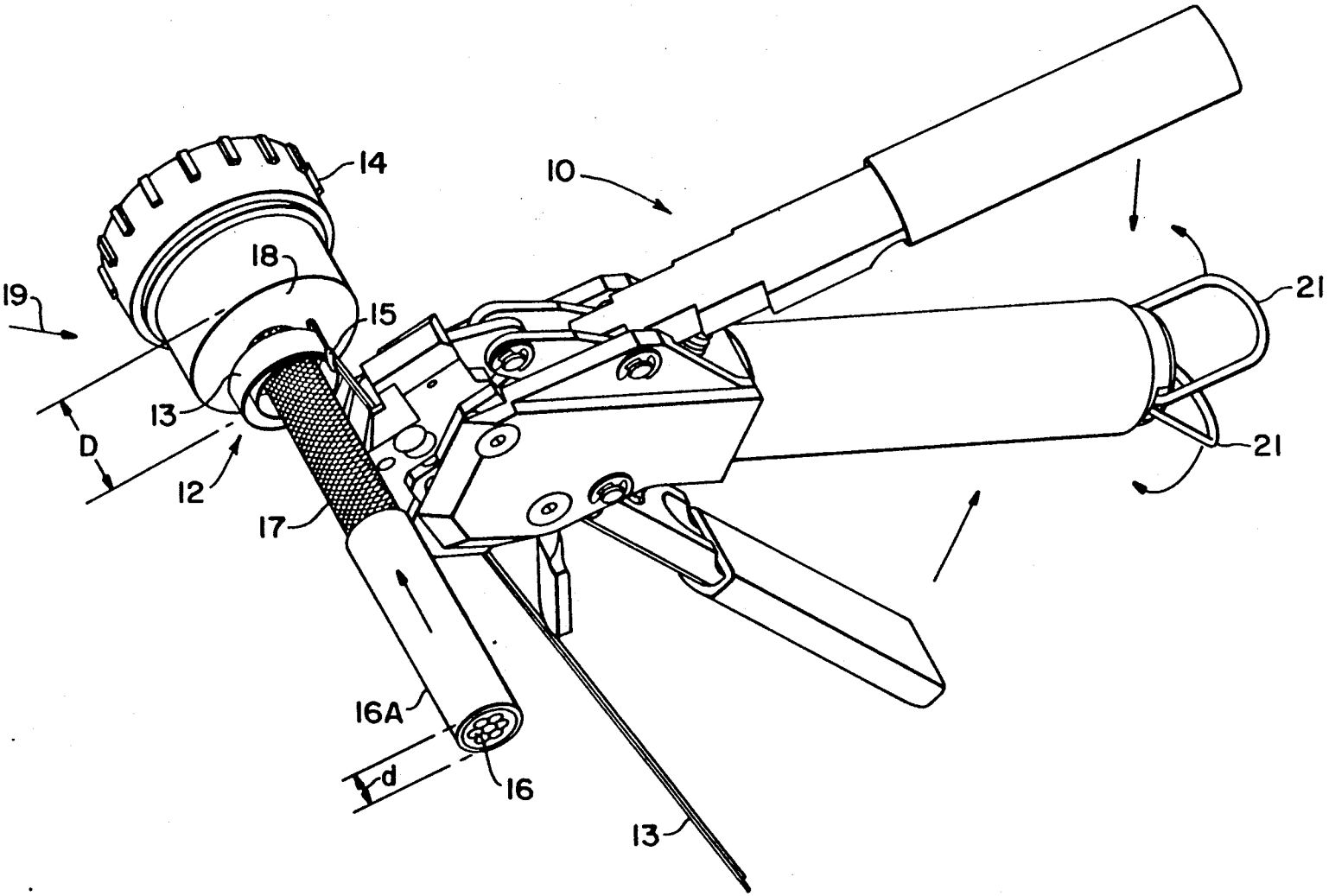
FIG. 1 is a perspective view of a tool constructed in accordance with the preferred embodiment of the present invention in use.

Referring first to FIG. 1, a perspective view of a tool constructed in accordance with the preferred embodiment of the present invention is generally identified by the reference numeral 10. The banding tool 10 is used to attach a band clamp 12 comprising a band 13 and a buckle 15 to a coupler 14 such as, for example, a back shell. The band clamp 12 is used to secure a protective shield 17 covering a cable 16 which is in turn attached to the coupler 14. Optional protective cover 16*a* such as heat shrink tubing can be installed to cover the shield 17 and the buckle 15.

Due to a larger diameter D of the coupler 14 in comparison to a diameter d of the shield 17, a flange 18 is formed proximate the connection therebetween. As a result of the banding tool 10, the band clamp 12 may be positioned proximate the flange 18 as required for the preferred connection configuration. Also, due to the symmetrical design of the tool 10, the band clamp 12 may be positioned proximate the flange 18 from either direction (i.e. the tool 10 may also be used to apply the clamp 12 from a direction indicated by an arrow 19, directly opposite the direction as shown in FIG. 1) with equal success. It should be noted that the tool 10 may be provided with handle locks 21 that allow the tool 10 to be stored in a more compact and space efficient manner.

Figure 2A:
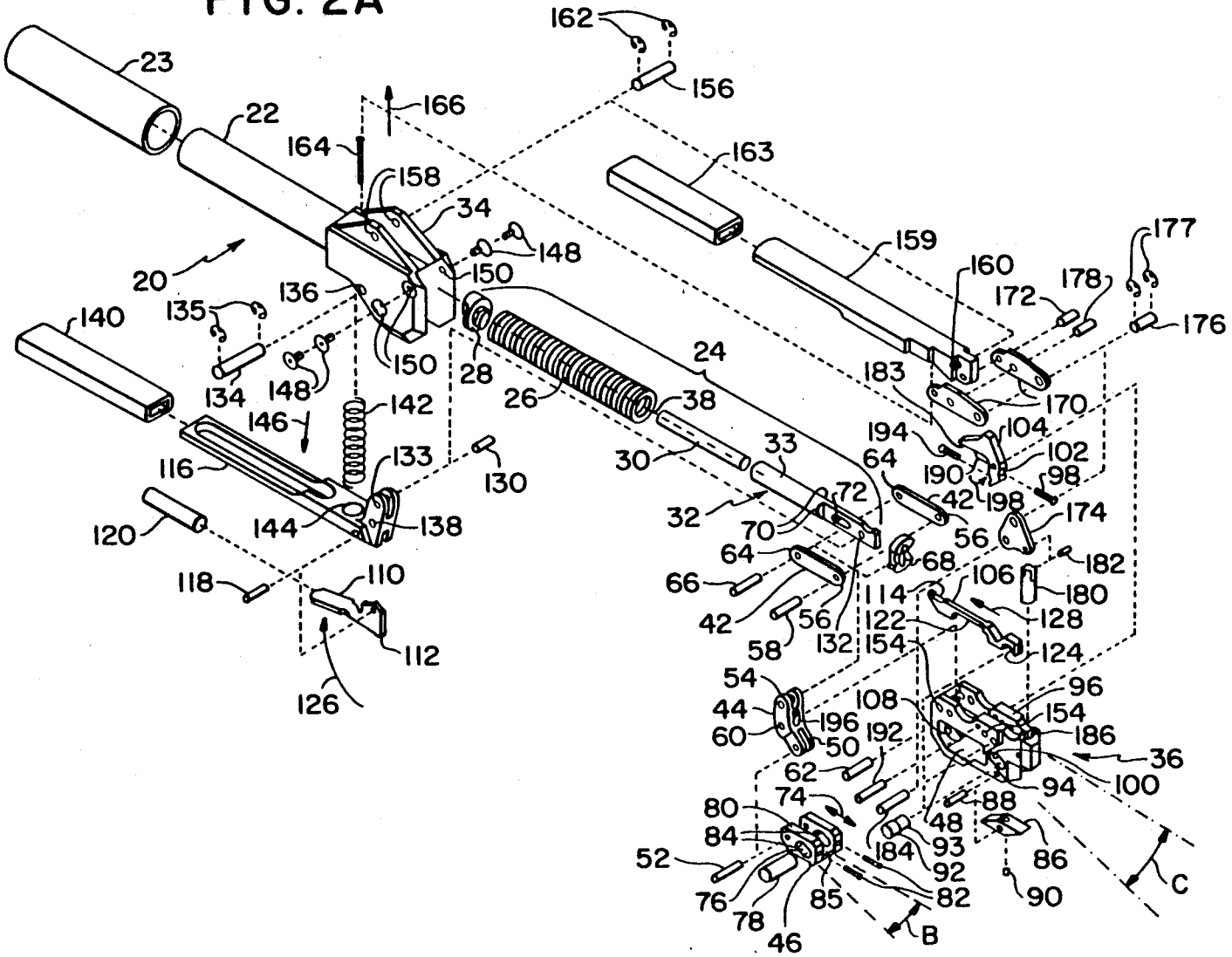
FIGS. 2*a, b,* and *c* are exploded perspective views of the tool of the present invention.

Referring simultaneously to FIGS. 2*a,* 2*b* and 2*c,* an exploded perspective view of the tool 10 is shown. A housing 20 receives and interconnects the various parts of the tool 10. Within a hollow handle 22 (the handle 22 may be provided with a protective covering 23 of a pliant material for comfort during use) of the housing 20 is a tensioning assembly 24. The tensioning assembly 24 comprises a force storing device 26, a tension adjustment plunger 28, a tension adjustment screw 30 and a connecting rod 32. The device 26 may comprise, for example, a compression spring, a rubber block or any other device capable of storing energy. Alternatively, the device 26 may comprise a power unit such as a hydraulic or pneumatic cylinder for powered actuation of the tool 10.

The screw 30 is threadably received into a tubular portion 33 of the rod 32. The plunger 28, upon assembly, is secured to the adjustment screw 30 to precompress the device 26 by threading into or out of the tubular portion 33 of the rod 32. A special tool (not shown) is preferably required to turn the plunger 28 and thus the screw 30 to prevent unauthorized changing of the setting of the desired recompression of the device 26. As will be subsequently described in greater detail, the device 26 is precompressed to allow a desired tension to be applied to the band clamp 12 around an object to be clamped.

The housing 20 also comprises a head receptacle 34 in which a head 36 (See FIG. 2*b*) is operably interconnected to the tensioning assembly 24. It is an important aspect of the present invention to note that upon assembly, a linear axis 38 passing through the tensioning assembly 24 intersects a linear axis 40 through the head 36 at an angle A (see FIG. 3*a*). The angle A may vary so long as the axis 38 and the axis 40 are not parallel to each other. The angular relationship between the assembly 24 and the head 36 allows the band 13 to be inserted into and through the tool 10 without the necessity of bending around an obstruction in the tool 10. Therefore, in comparison to prior devices the tool 10 is easy to load and most of the force in the tool 10 is used to tension the band 13 rather than to bend the band 13 around an obstruction.

The head 36 is interconnected to the assembly 24 by push links 42, tension transfer lever 44 and tension block 46. The tension block 46 is slidably inserted into a cavity 48 in the head 36 and connected to a first end 50 of the lever 44 by a pin 52. The lever 44 is also pivotally connected through a center hole 60 to the head 36 by a pin 62. A second end 54 of the lever 44 is pivotally connected to a first end 56 of the links 42 by a pin 58.

The links 42 are connected at a second end 64 to the connecting rod 32 by a pin 66. A support plunger 68 is secured to the rod 32 forcing pin 66 against forward end of elongated slot 72 on the rod 32 through which the pin 66 is positioned. Due to the slot 72, the pin 66 has a predetermined travel distance along the linear axis 38, as will be subsequently described in greater detail.

Figure 2C:
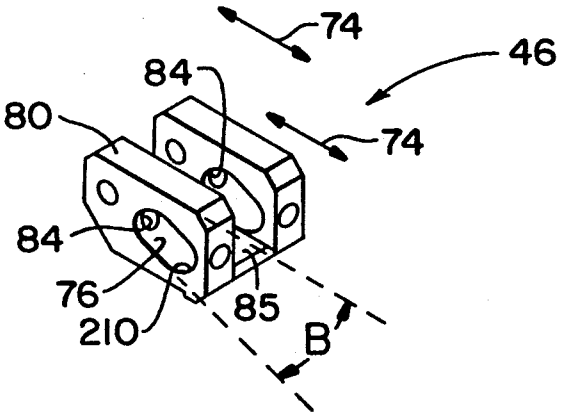

The cavity 48 in the head 36 is dimensioned to allow the tension block 46 to slide in a back-and-forth direction as indicated by a double-headed arrow 74. Received within an elongated slot 76 (see FIG. 2*c*) in the tension block 46 is a tension pin 78. The slot 76 is formed at an angle B (which may comprise, for example 10°-17°) relative to a top surface 80 of the block 46 to allow pressure to be applied and released by the tension pin 78 to the band 13 of the band clamp 12, as will be subsequently described in greater detail. A pair of springs 82 are inserted into holes 84 in the block 46 to bias the pin 78 toward an edge 210 (see FIG. 2*c*) of the slot 76 and into contact with the band 13 of the band clamp 12 which passes therebetween and a bottom surface 85 of the block 46.

A tension holding pin 92 is slidably received within an elongated slot 94 in the head 36. The pin 92 is held within the slot 94 by engagement of a groove 93 therein by a tension hold/release link 106. Thus the width of the tool 10 at the head 36 is kept to approximately the same width as the buckle 15.

Figure 2B:
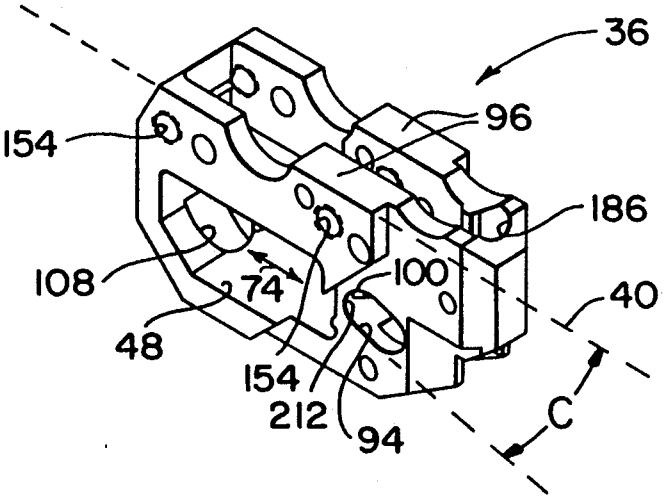

The slot 94 is formed at an angle C (which may comprise, for example, 10°-17°) relative to a top surface 96 of the head 36 (see FIG. 2*b*). The pin 92 is biased away from an edge 212 of the slot 94 by a spring 98 which fits through the head 36 in opening 100. The spring 98 is held in place by a recess 102 in a tension holding hook 104. The band 13 of the band clamp 12 is gripped between the tension holding pin 92 and a cut-off blade 86. Thus the tension holding pin 92 is biased to hold the band 13 from slipping or being pulled from the tool 10. The cut-off blade 86 may be reversibly fixed within the head 36 by a pin 88. A jam screw 90 is threadable into the blade 86 to hold pin 88 in place and to provide convenient means to remove cut-off blade 86.

The tension hold/release link 106 fits within the head 36 through an opening 108 for cooperation with a tension hold/release hook 110. The link 106 and hook 110 are interconnected by the mating of a male portion 112 on the hook 110 with a slot 114 on the link 106. The hook 110 is pivotally connected to a pull-up handle 116 by a pin 118. The hook 110 may be provided with a pliant cover 120 for comfort of use.

The link 106 has a first cut-out 122 and a second cut-out 124. When the link 106 is installed within the head 36, the first cut-out 122 interacts with the tension pin 78 of the tension block 46 while the second cut-out 124 interacts with the tension holding pin 92 within the elongated slot 94 of the head 36. By actuating the hook 110 in a direction indicted by an arrow 126 the hook 110 pivots about the pin 118 to pull the link 106 in a direction indicated by an arrow 128.

The first cut-out 122 and the second cut-out 124 thus contact the tension pin 78 and the tension holding pin 92, respectively, and pull the pins against their spring bias. Thus, an operator is able to insert a band 13 of the band clamp 12 without interference from the tool 10.

The link 106 also provides an automatic self adjustment when clamping various materials such as steel versus rubber. For example, if the band clamp 12 encircles a rubber tube, there will be a greater tendency (than with steel) for the rubber to try to re-expand and to pull the tension holding pin 92 into the elongated slot 94 away from the edge 212 (thus gripping the band 13 tighter). This forward motion of pin 92 would reduce the total stroke tool 10 could apply to band 13, resulting in lower tensioning force. Due to the interconnection with the tension pin 78 through the link 106, the tension pin 78 will be similarly allowed to move farther into its elongated slot 76 toward the edge 210 for greater gripping strength, thus adjusting automatically for a longer stroke.

The pull up handle 116 is pivotally connected to the connection rod 32 by a pin 130 passing through holes 132 and 133. The pull up handle 116 is pivotally connected to the head receptacle 34 by a pin 134 through a hole 136 in the head 34 and a hole 138 in the handle 116 and is held in position by snap rings 135. The handle 116 may be provided with a pliant cover 140 for comfort of operation. A spring 142 is inserted into a receptacle 144 in the handle 116 and into the head receptacle 34 to bias the handle 116 in a direction indicated by an arrow 146.

A plurality of bolts 148 fit into holes 150 in the head receptacle 34 and are threadably received by the head 36 within holes 152 therein. Thus, the head 36 is secured within the head receptacle 34 by the bolts 148.

A cutoff handle 154 is pivotally attached to the head receptacle 34 by a pin 156, secured in place by a pair of snap rings 162, passing through holes 158 in the receptacle 34 and a hole 160 in the handle 154. A spring 164 is positioned between the handle 15 and the head receptacle 34 to bias the handle 154 in a direction indicated by an arrow 166. The handle 154 may also be provided with a pliant cover 168 for comfort of operation.

A pair of cutoff links 170 are pivotally attached to the handle 154 by a pin 172. The cutoff links 170 are pivotally attached at an end opposite the handle 154 to a cutoff arm 174 by a pin 176 which is held in place by snap rings 177. A pin 178 passes through the links 170 for interaction with the tension holding hook 104, as will be subsequently described in greater detail. The cutoff arm 174 is pivotally connected to a cutoff knife 180 by a pin 182 and to the head 36 by a pin 184. The cutoff knife 180 is slidably received within a receptacle 186 in the head 36 for cooperation with the cutoff blade 86 to sever the band 13, as will be subsequently described in greater detail.

The tension holding hook 104 has a hook 188 and a cam surface 190. The tension holding hook 104 is pivotally connected to the head 36 by a pin 192. A spring 194 is received by the tension holding hook 104 and a receptacle 196 in the tension transfer lever 44. The spring 194 biases the tension holding link 104 in a counterclockwise direction, as indicated by an arrow 198, about the pin 192.

Figures 3A, 3B:
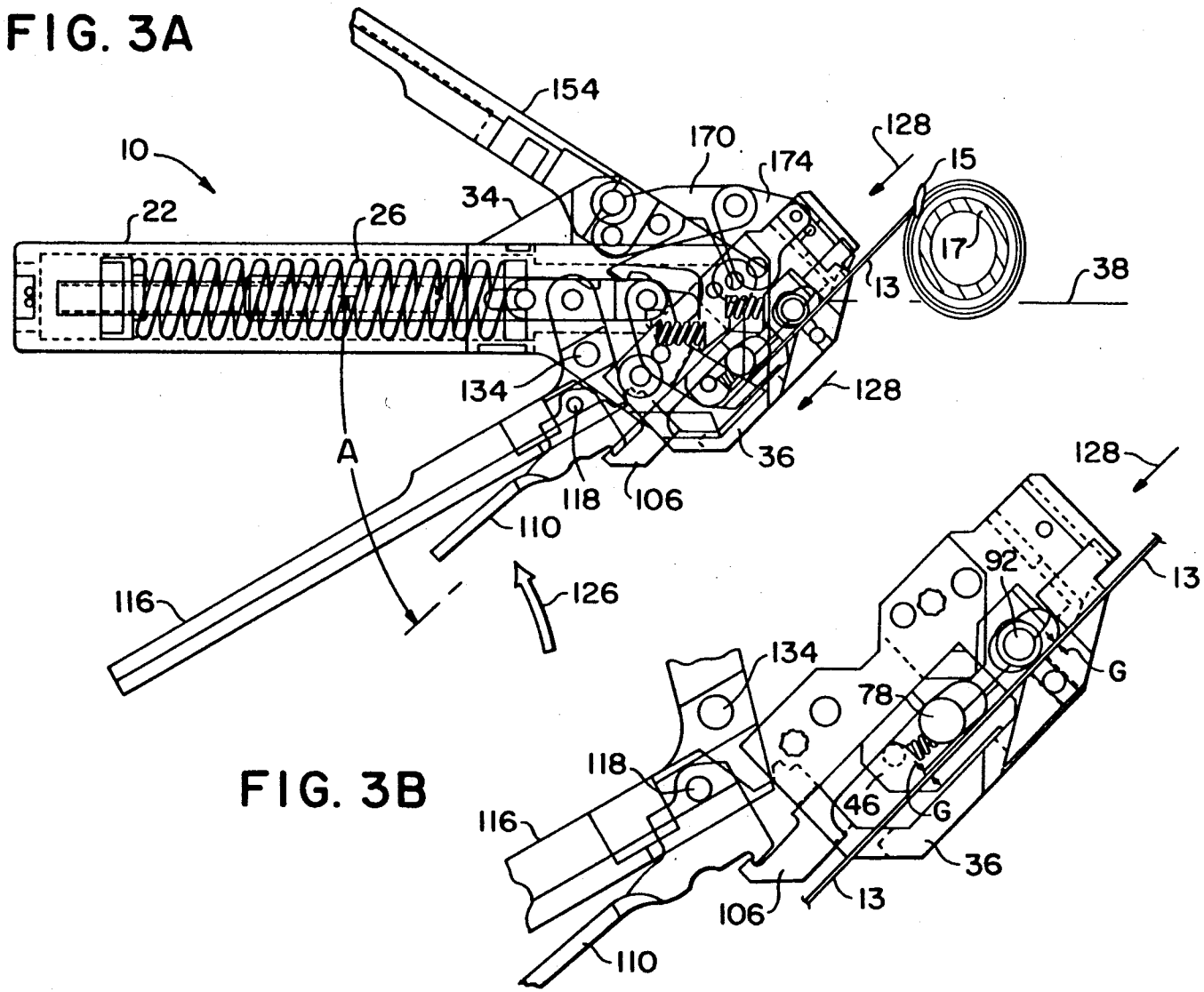
FIGS. 3*a* and *b* are cross-sectional views of the tool with a band clamp to be tensioned being inserted therein.

The operation of the tool 10 will now be discussed with reference to FIGS. 3 through 8. Referring first to FIGS. 3*a* and 3*b*, the insertion of a band clamp 12 into the tool 10 is illustrated. With the pull up handle 116 and the cutoff handle 154 in their spring biased positions, the tension hold/release hook 110 is grasped by an operator and moved in the direction 126. Movement of the hook 110 in the direction 126 causes the tension hold/release link 106 to move in the direction 128. Thus, the tension pin 78 and the tension holding pin 92 are moved in their respective holes against their spring bias to form gaps G therebetween and the bottom surface 85 of the tension block 46 and the cutoff blade 86 which are at least slightly greater than the thickness of the band 13. The gaps G thus formed allow the band 13 to be inserted in the direction 128 into the tool 10. Due to the angle A between the linear axis 38 of the tensioning means 24 and the linear axis 40, the band 13 is maintained straight without the necessity of bending thereof around internal parts of the tool 10. Thus, tensioning of the band 13 and insertion thereof into the tool 10 is relatively easier than in prior art devices.

Figure 4B:
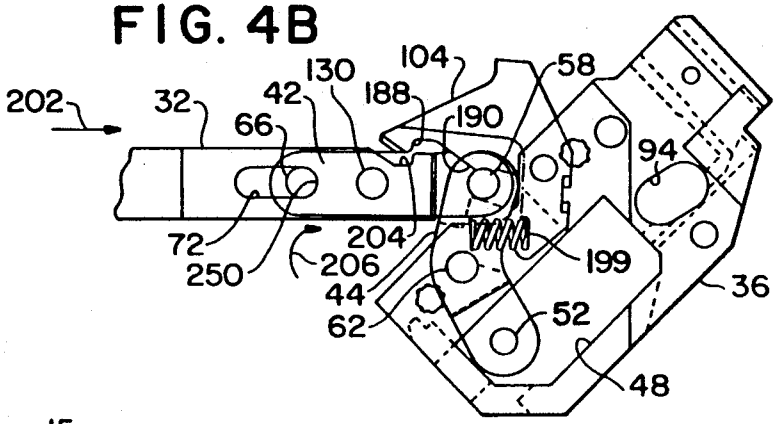
FIGS. 4*a, b* and *c* are cross-sectional views of the tool in an upstroke position.
Figure 4C:
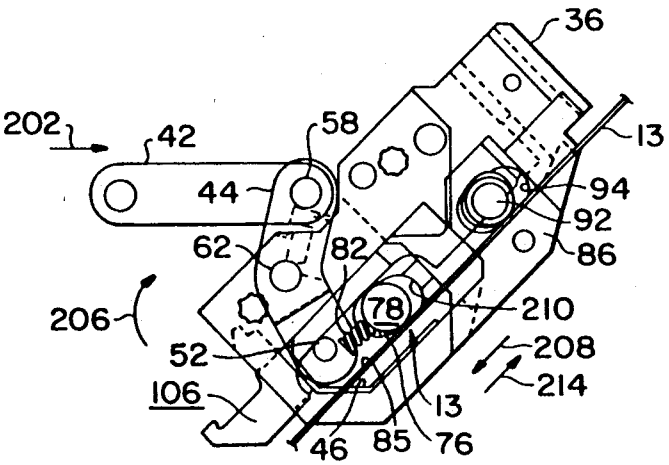
Figure 4A:
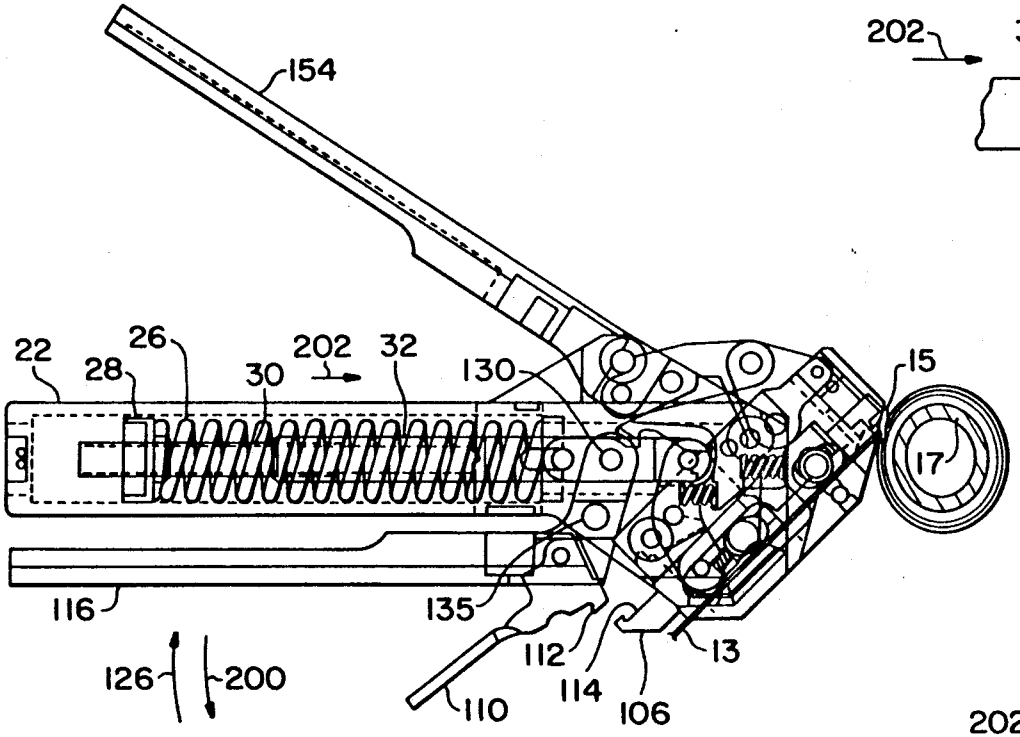

Referring to FIGS. 4*a*, 4*b* and 4*c* the tool 10 is shown in the tensioning mode. The pull up handle 116 is pulled back-and-forth as indicated by the arrow 126 and an arrow 200 between the position as shown in FIG. 4*a* and the position as shown in FIG. 3*a*. As the handle 116 is moved in the direction 126, the tension hold/release hook 110 is not engaged with the tension hold/release link 106.

As the handle 116 pivots about the pin 135, the connecting rod 32 is moved in a direction indicated by an arrow 202 as a result of the interconnection thereto by the pin 130. As can be seen in FIG. 4*b*, movement of the rod 32 similarly causes movement of the push links 42 in the direction 202. Movement of the links 42 in the direction 202 is caused by the pin 66 engaging a front edge 250 of the slot 72 in the connecting rod 32. The pin 66 is held against the edge 250 by the support plunger 68 which is in turn pushed in the direction 202 by the storing device 26. As long as the tension in the band 13 does not overcome the recompression of the device 26 the pin 66 is held against the edge 250. In other words, the assembly 24 acts as a solid rod until the band 13 reaches the predetermined tension.

Therefore, as the link 42 moves in the direction 202 the tension transfer lever 44 is forced to pivot in a clockwise direction as indicated by an arrow 206 about the pin 62 as a result of the interconnection therebetween with the link 42 by pin 58. As the pin 58 moves in the direction 202 it slides along the cam surface 190 of the tension holding hook 104 against the bias of the spring 194 and the hook 188 thereof is held out of the slot 204 in the connecting rod 32. Thus, an operator knows that the band 13 has not been tensioned the desired amount and further cycling of the handle 116 is required.

Referring to FIG. 4*c*, as the link 42 moves in the direction 202, the transfer lever 44 pivots in the clockwise direction 206. Due to the interconnection between the lever 44 and the tension block 46 by the pin 52, the tension block 46 is moved in a direction indicated by an arrow 208. Movement of the tension block 46 in the direction 208 forces the tension pin 78 toward the edge 210 of the elongated slot 76 therein, and the band 13 is gripped between the pin 78 and the bottom surface 85 of the block 46. Thus as the handle 116 moves in the direction 126, the band 13 is moved in the direction 208 to increase the tension therein. As the band 13 is moved in the direction 208 by the pin 78 and the block 46, the pin 92 is moved toward the edge 212 of the elongated slot 94. Thus the band 13 is allowed to pass between the pin 92 and the cut-off blade 86.

When the handle 116 is moved in the direction 200, the block 46 is moved in a direction indicated by an arrow 214. As the block 46 moves in the direction 214, tension in the band 13 causes the band 13 to also try to move in the direction 214. The tension in the band 13 and the bias of the spring 98 thus moves the pin 92 away from the edge 212 in the slot 94 and holds the band 13 from movement in the direction 214. Similarly, movement of the block 46 in the direction 214 causes the pin 78 to move against the bias of the spring 82 and away from the edge 210 in the slot 76, allowing the pin 78 to pass freely over the band 13. Therefore, the handle 116 is cycled in the direction 126 and 200 as described to gradually tension the band 13 around the shield 17.

It is an advantage of the tool 10 that the handle 116 and lever 44 is used rather than toggles, as are found in the prior art. The handle 116 and the lever 44 provide a mechanical advantage over toggles allowing fewer cycles of the handle 116 to move the band farther than in a corresponding toggle tool. Although not shown, it is to be understood that by varying the length of the lever 44 about the pin 62, various mechanical advantages may be achieved. Additionally, the use of the force storing device 26 such as a precompressed spring allows the tool 10 to be smoother, easier to operate and more accurate than prior devices.

Figure 5A:
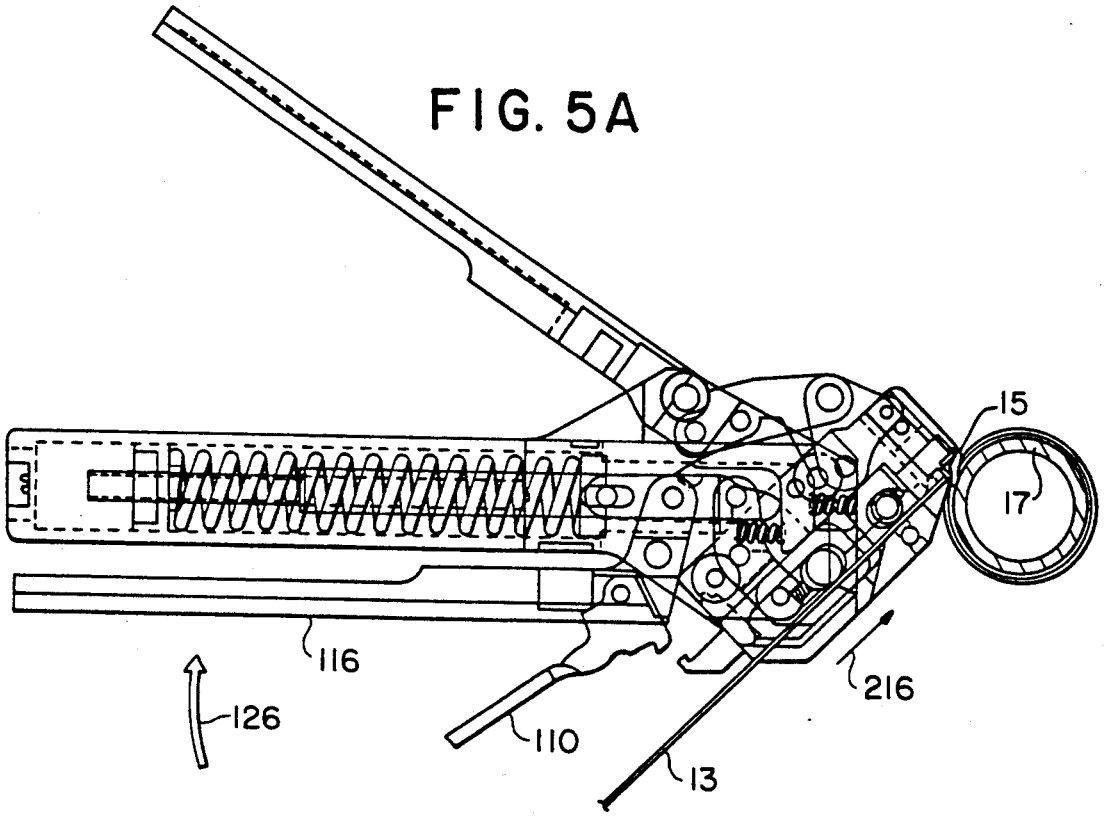
FIGS. 5*a* and *b* are cross-sectional views of the tool in the signal position.
Figure 5B:
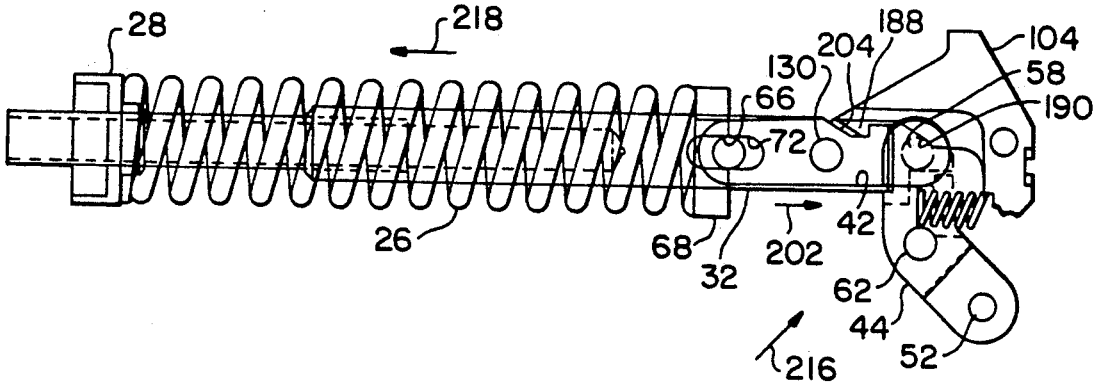

Referring to FIGS. 5*a* and 5*b*, the band 13 has been pulled to the desired tension within the tool 10. When the desired tension is reached, the handle 116 is locked in the position as shown in FIG. 5*a*. In the locked condition, the spring 142 (see FIG. 2*a*) is unable to return the handle 116 to the position shown in FIG. 3*a*, and the operator knows that the desired tension has been reached.

As best seen in FIG. 5*b*, when the tension in the band 13, as indicated an arrow 216, exceeds the recompression of the storing device 26, the device 26 further compresses in a direction indicated by an arrow 218. Thus the support plunger 68 and the pin 66 also move in the direction 218 as the connecting rod 32 moves in the direction 202. Since the pin 58 is also connected to the push links 42, the pin 58 does not move in the direction 202 and does not ride along the cam surface 190 of the tension holding hook 104. Thus the hook 188 thereon enters the slot 204 on the connecting rod 32 to lock the handle 116 in the position as shown in FIGS. 5*a* and 5*b*.

Figure 6A:
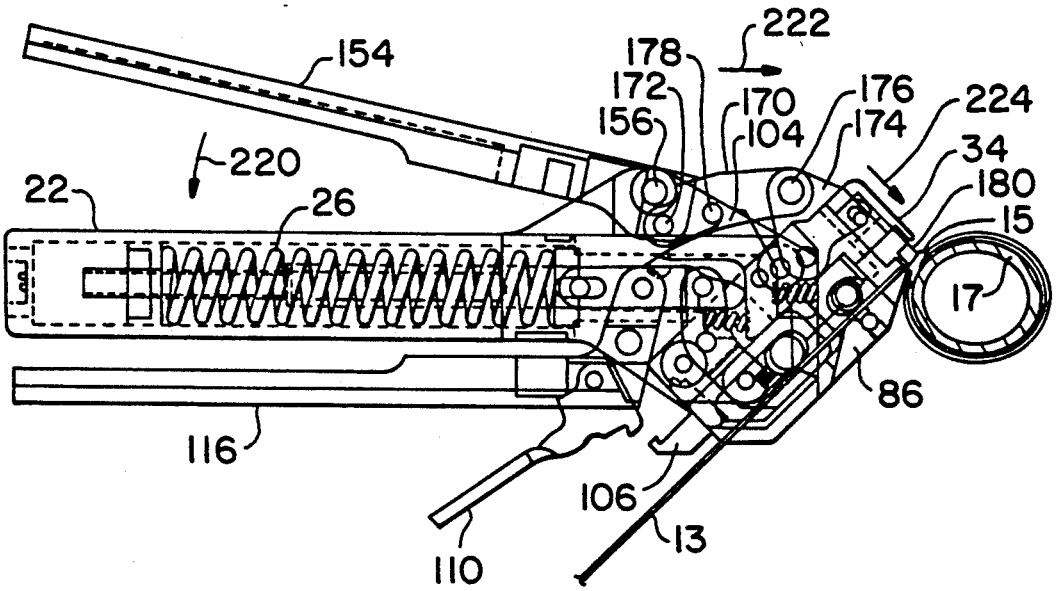
FIGS. 6*a, b* and *c* are side cross-sectional views of the cutting operation.
Figure 6B:
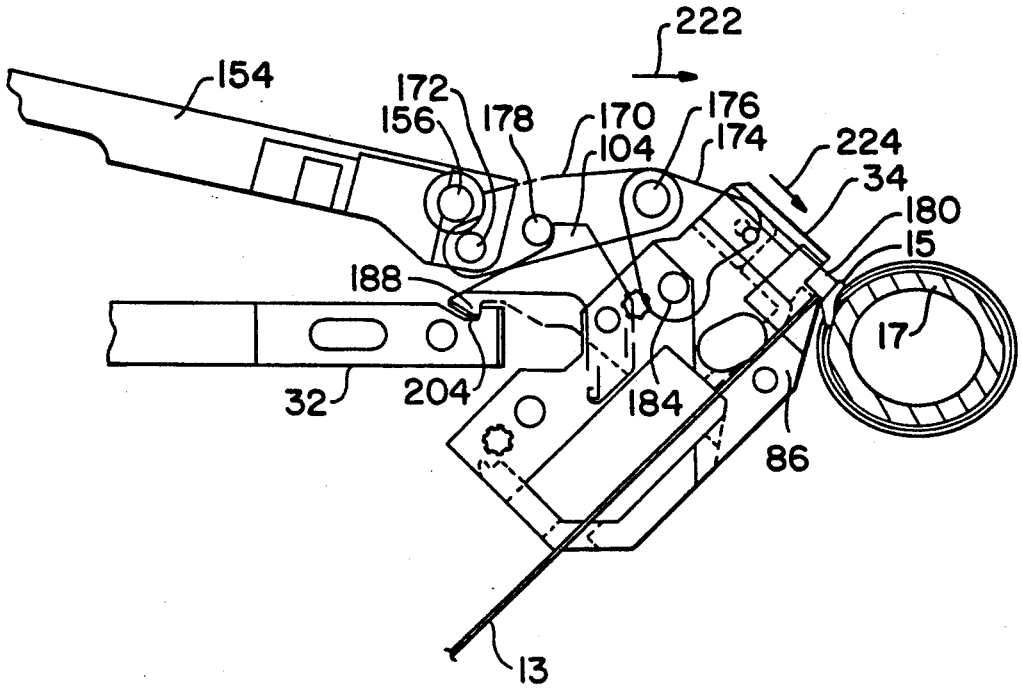
Figure 6C:
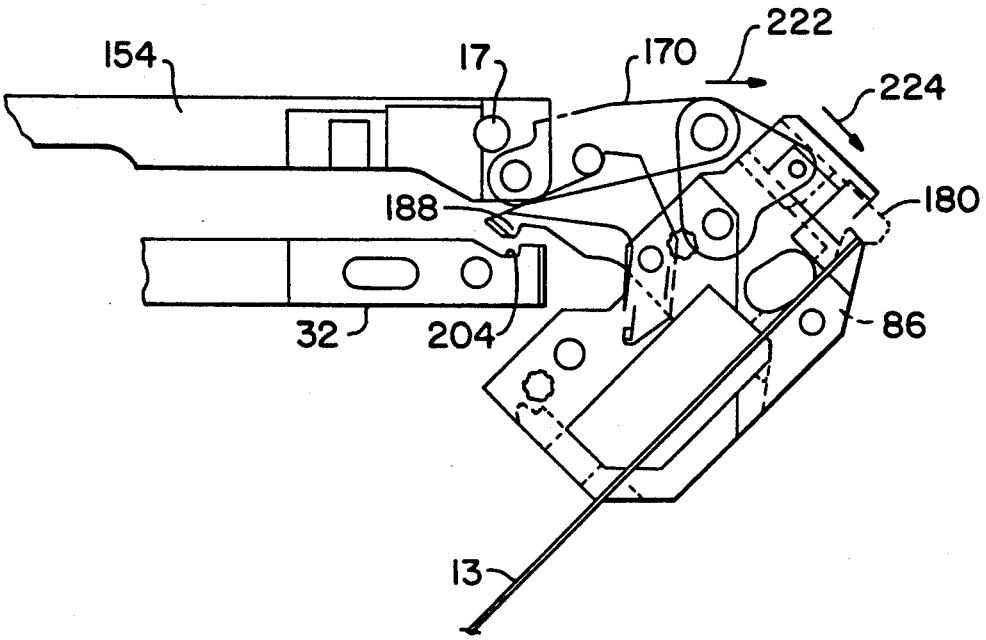

Referring to FIGS. 6*a*, 6*b* and 6*c*, the cut-off sequence is illustrated. Referring first to FIGS. 6*a* and 6*b*, the pull up handle 116 is in the uppermost locked position. The cut-off handle 154 pivots in a direction as indicated by an arrow 220 about pin 156 which moves the cut-off links 170 in a direction indicated by an arrow 222. Movement of the links 170 in the direction 222 causes the cut-off arm 174 to pivot clockwise about the pin 184. The clockwise rotation of the cut-off arm 174 moves the cut-off knife 180 in a direction indicated by an arrow 224. The cut-off knife 180 first contacts the buckle 15 and then bends and severs the band 13 therebetween and the cut-off blade 86, as will be subsequently described in greater detail. Simultaneously, the pin 178 contacts the tension holding hook 104 to push the hook 104 in the direction 222 and thus release the hook 188 from the slot 204 (as shown in FIG. 6*c*) which will allow the pull up handle 116 to return to the extended position as shown in FIG. 3*a*.

Figures 7A, 7B, 7C:
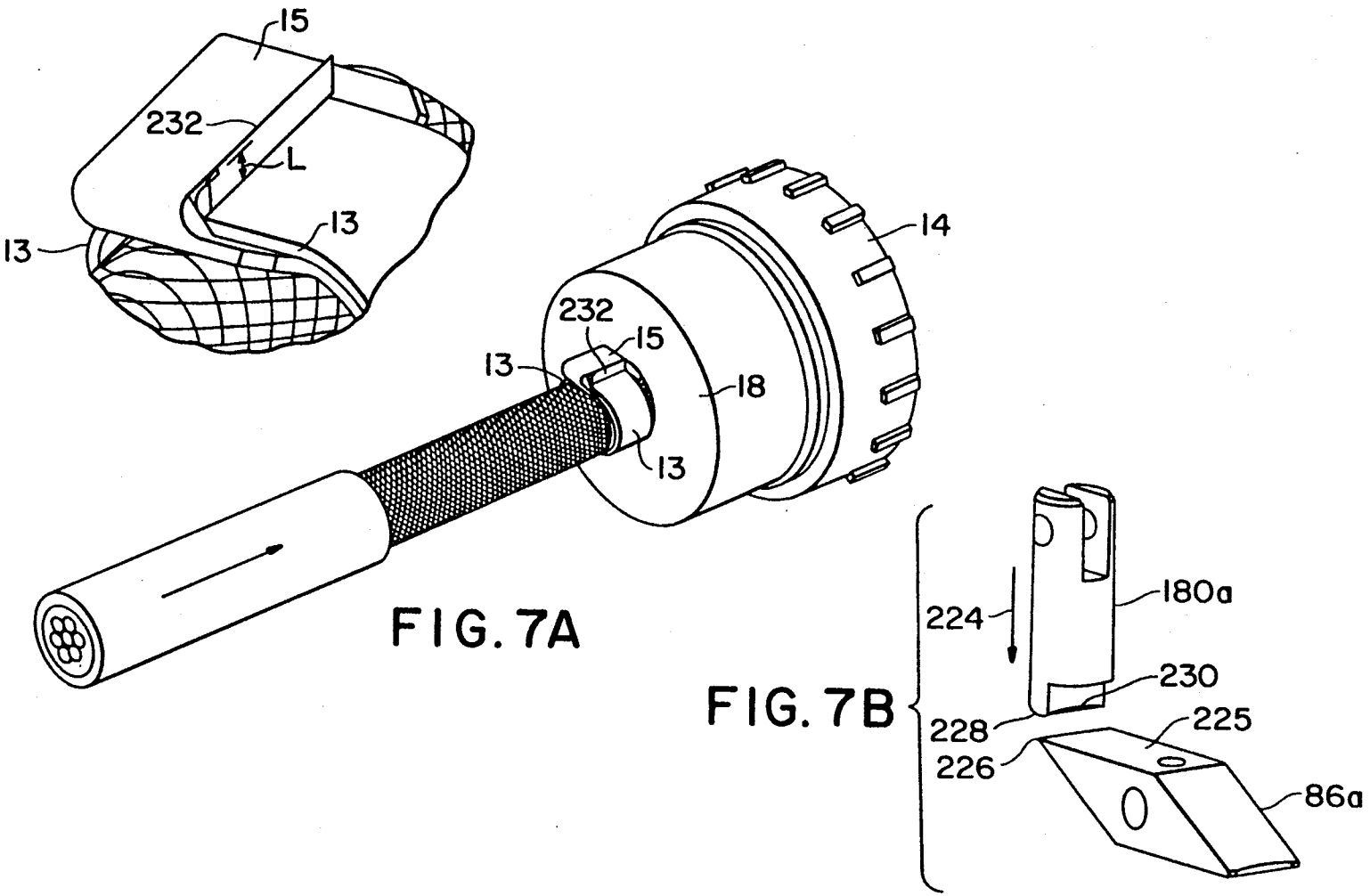
FIGS. 7*a* and *b* are isometric views of one embodiment of a locking tab and the hardware required for formation thereof.
FIG. 7C is a close-up detail of the engagement between the band and the buckle illustrated in FIG. 7A.

Referring to FIGS. 7*a* and 7*b*, one embodiment of a cut-off arrangement is illustrated. Referring first to FIG. 7*b*, the cut-off blade 86 and the cut-off knife 180 are shown in perspective. The cut-off blade 86 which is reversible within the tool 10, provides a flat surface 225 for cooperation with the tension holding pin 92 to hold the band 13 therebetween. A cutting and bending edge 226 is provided for cooperation with the knife 180*a*.

As the knife 180*a* is pushed in the direction 224 by movement of the cut-off handle 154, a lower surface 228 thereof first contacts the buckle 15. Interaction between the lower surface 228, the buckle 15 and the upper surface 225 of the blade 86*a* causes the band 13 to be first bent and then severed. Due to an arcuate cutter 230 on the cut-off knife 180*a*, an arcuate tab 232 as shown in FIG. 8*a* is formed. The length L of the tab 232 is controlled by the thickness of the buckle 15 and the vertical location of the arcuate cutting edge 230. As the buckle 15 is pushed in the direction 224 by the knife 180*a*, the band 13 is bent by the buckle 15 before being severed by the arcuate cutter 230.

Figure 8B:
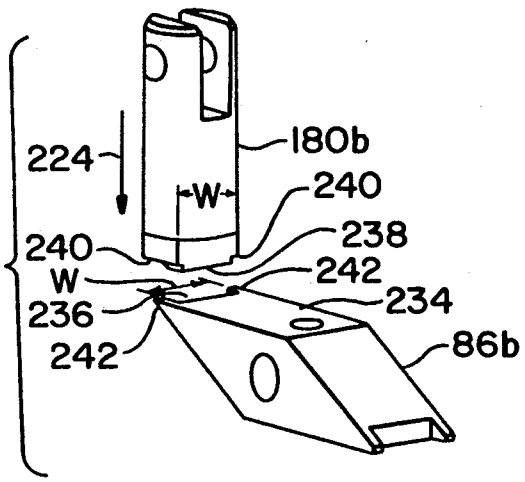
FIGS. 8*a* and *b* are isometric views of another embodiment of a locking tab and the hardware required for formation thereof.
FIG. 8C is a close-up detail view of the engagement between the band and the buckle illustrated in FIG. 8A.
Figure 8A:
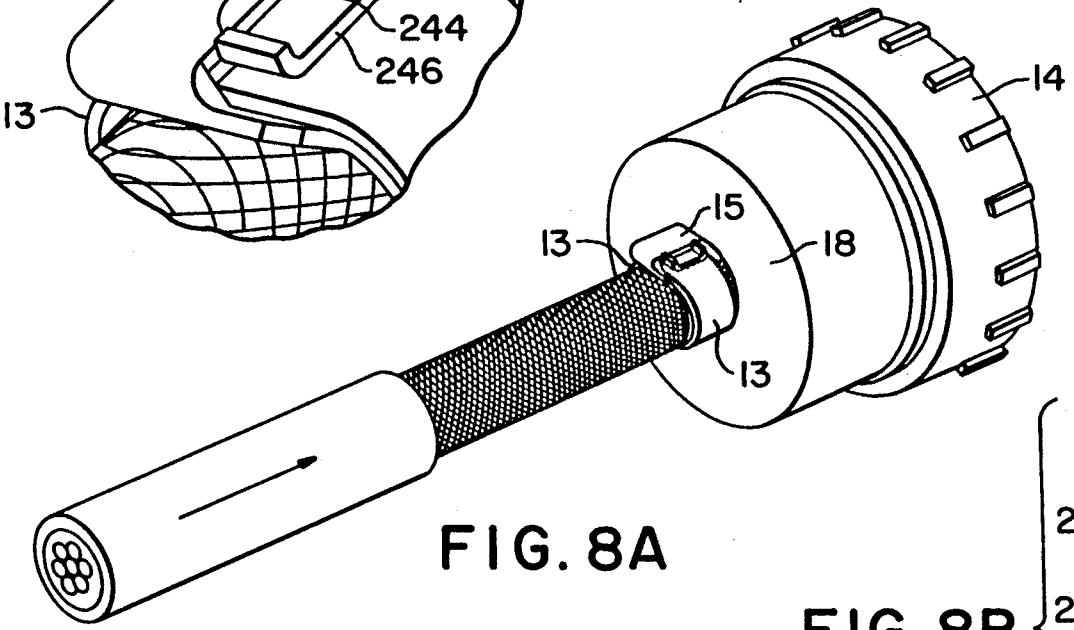
Figure 8C:
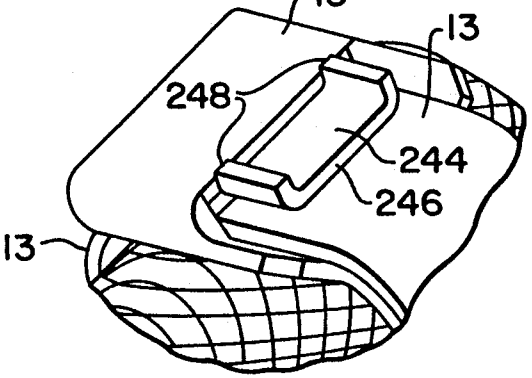
Figure 9A:
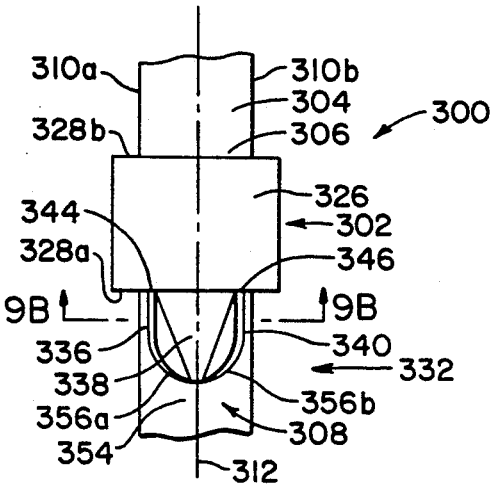
FIGS. 9*a*–9*d* are, respectively, top, cross-sectional end, side, and perspective views of one embodiment of a lock.
Figure 9C:
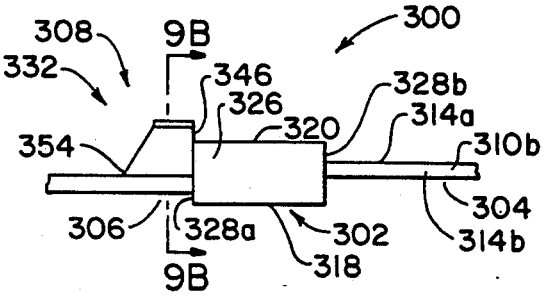
Figure 9B:
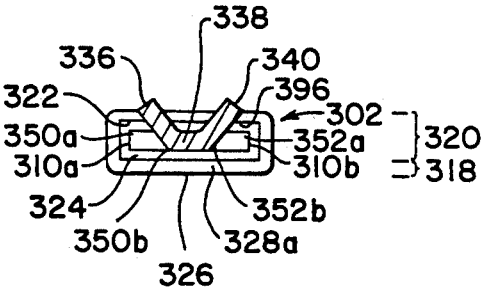
Figure 9D:
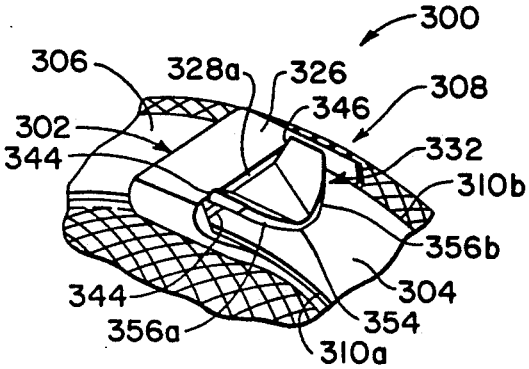
Figure 10A:
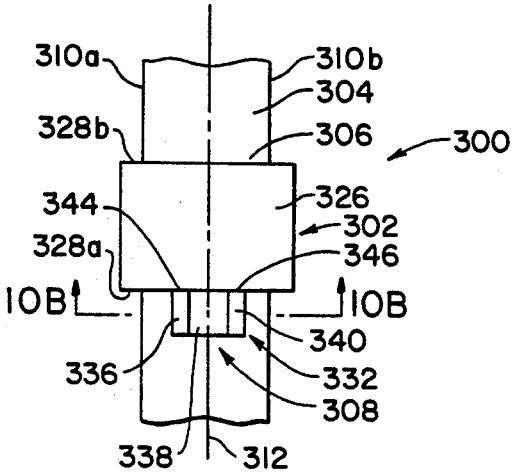
FIGS. 10*a*–10*d* are, respectively, top, cross-sectional end, side, and perspective views of another embodiment of a lock.
Figure 10C:
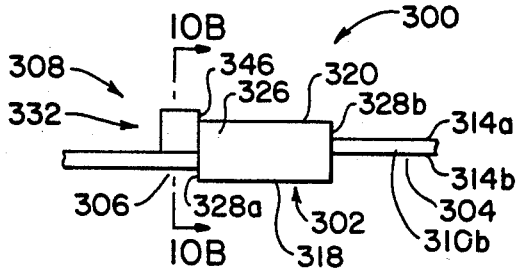
Figure 10B:
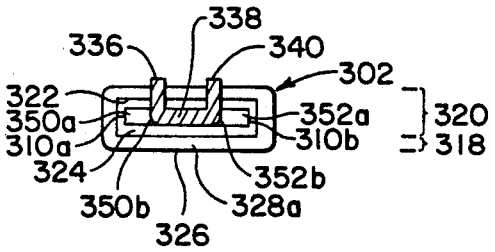
Figure 10D:
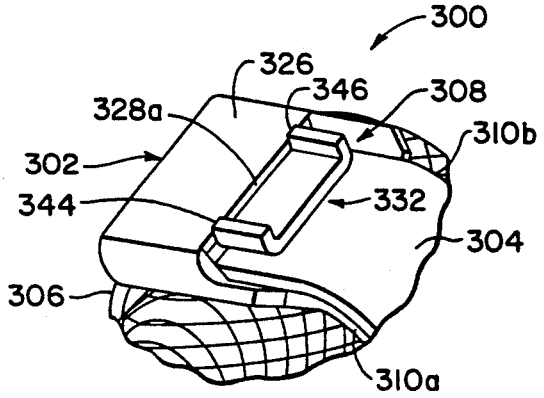
Figure 11A:
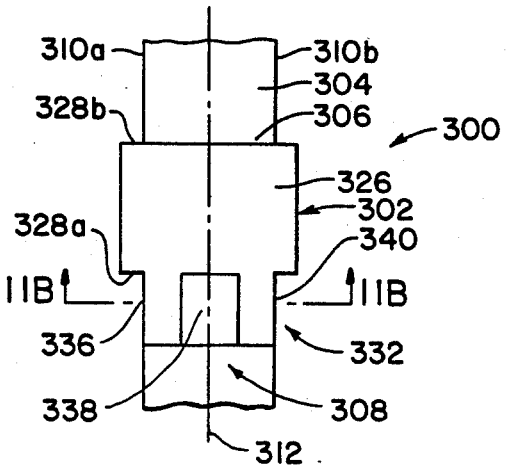
FIGS. 11*a*–11*d* are, respectively, top, cross-sectional end, side, and perspective views of another embodiment of a lock.
Figure 11C:
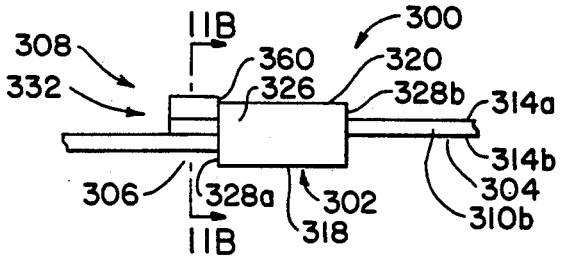
Figure 11B:
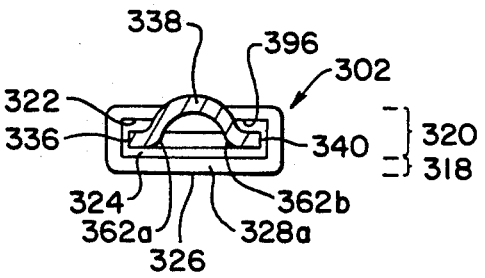
Figure 11D:
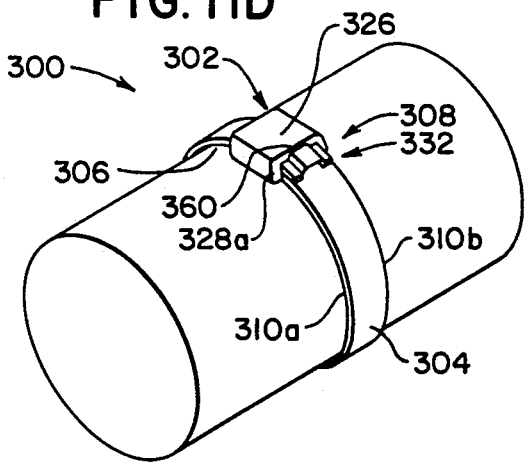
Figure 12A:
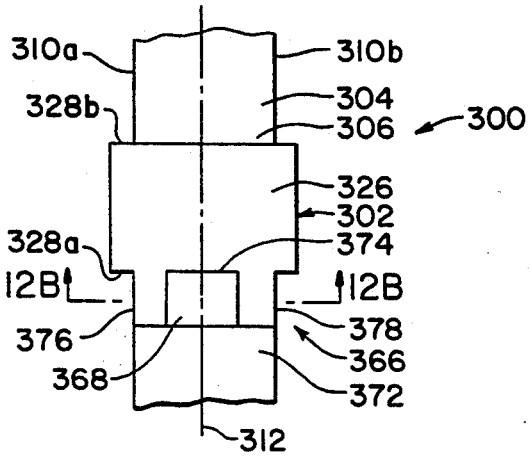
FIGS. 12*a*–12*d* are, respectively, top, cross-sectional end, side, and perspective views of another embodiment of a lock.
Figure 12C:
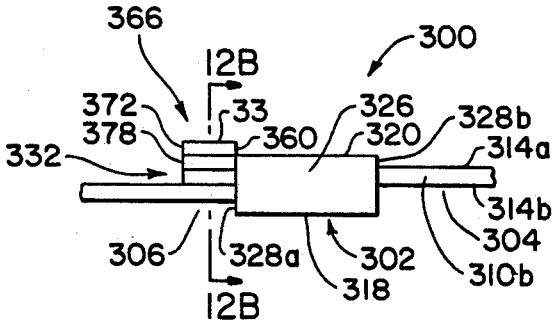
Figure 12B:
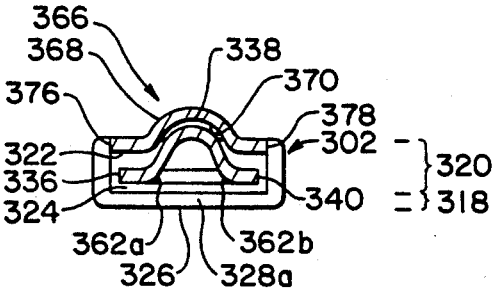
Figure 12D:
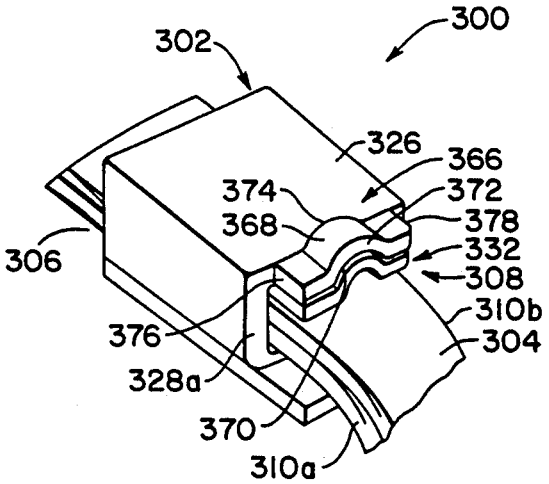
Figure 13A:
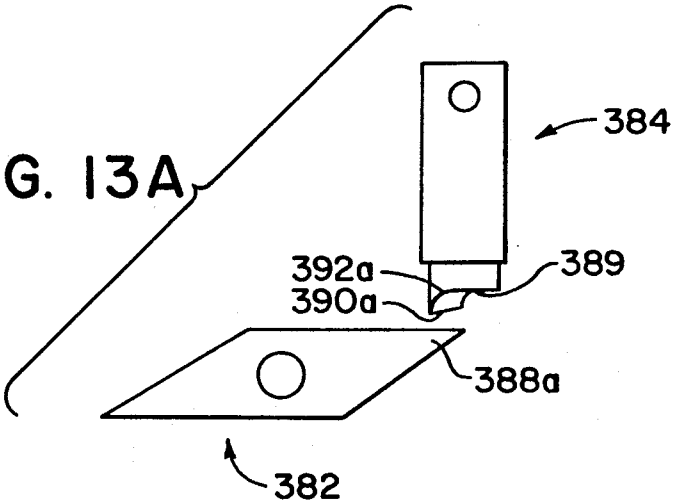
FIGS. 13*a*–13*d* are, respectively, side, bottom, front, and perspective views of a cut-off knife and cut-off blade used to form the lock illustrated in FIGS. 9*a*–9*d;*
Figure 13B:
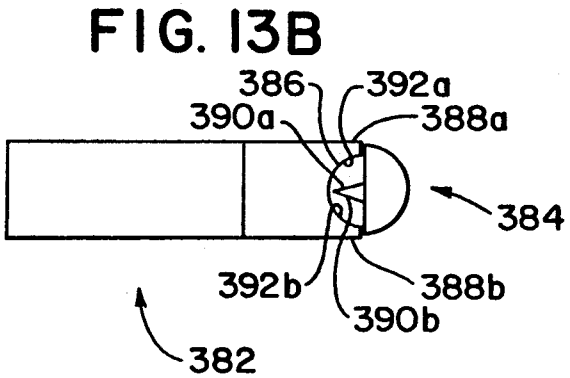
Figure 13C:
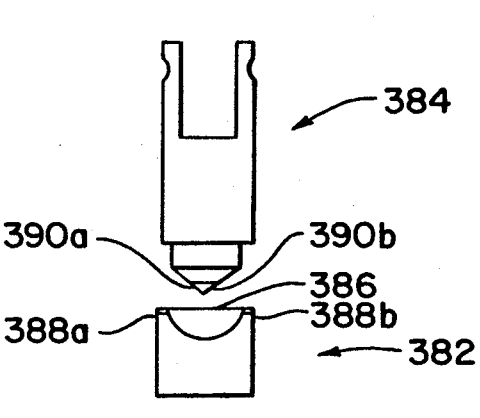
Figure 13D:
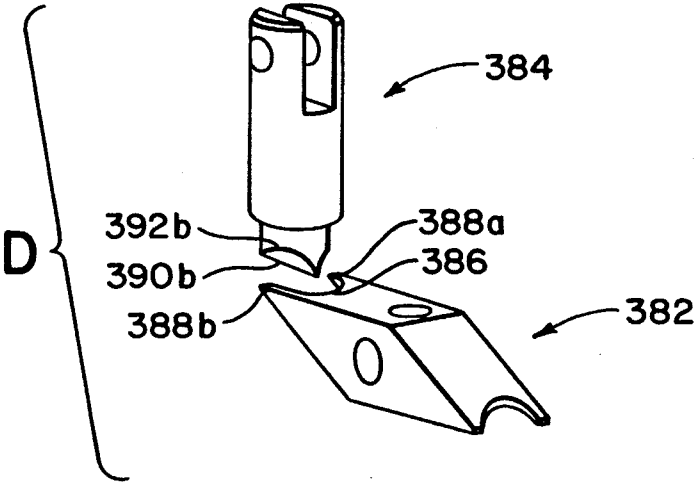
Figure 14C:
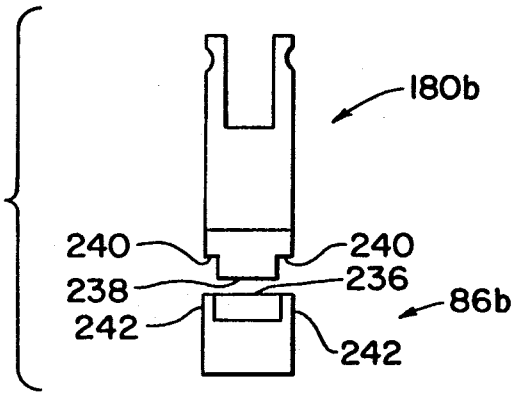
FIGS. 14*a*–14*d* are, respectively, side, bottom, front, and perspective views of a cut-off knife and cut-off blade used to form the lock illustrated in FIGS. 10*a*–10*d.
Figure 14D:
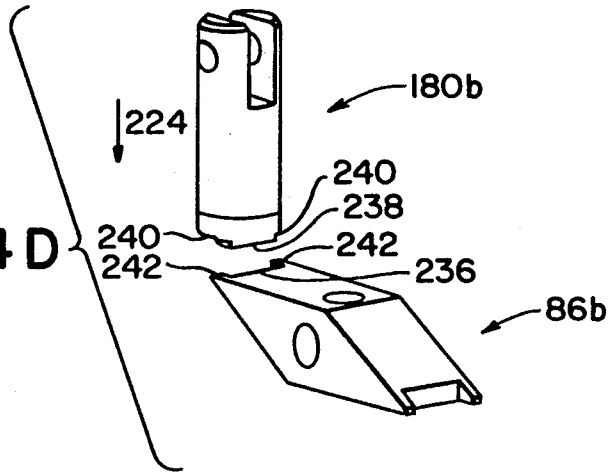
Figure 14A:
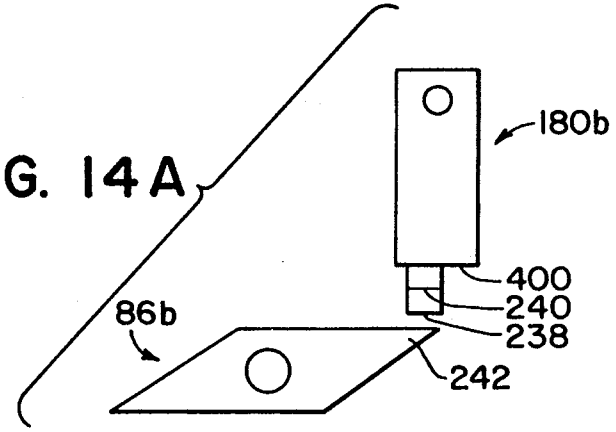
Figure 14B:
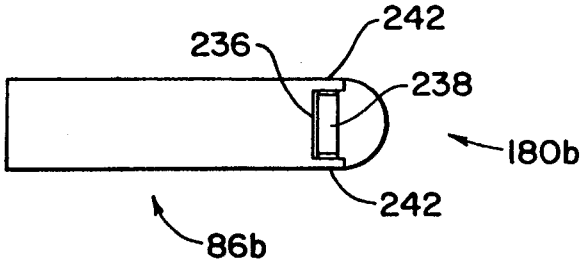
Figure 15C:
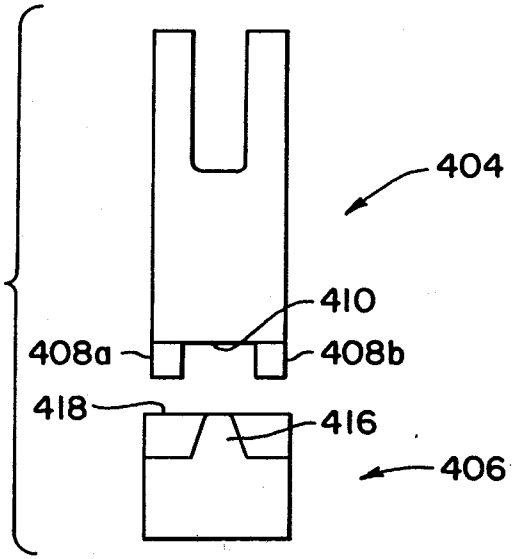
* and FIGS. 15*a*–15*d* are, respectively, side, bottom, front, and perspective views of a cut-off knife and cut-off blade used to form the lock illustrated in FIGS. 11*a*–11*d* and 12*a*–12*d.*
Figure 15D:
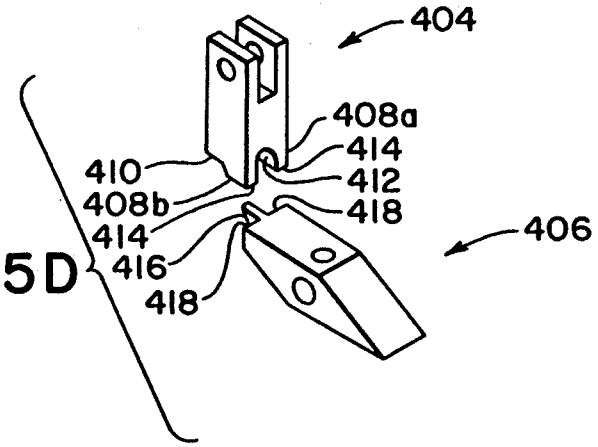
Figure 15A:
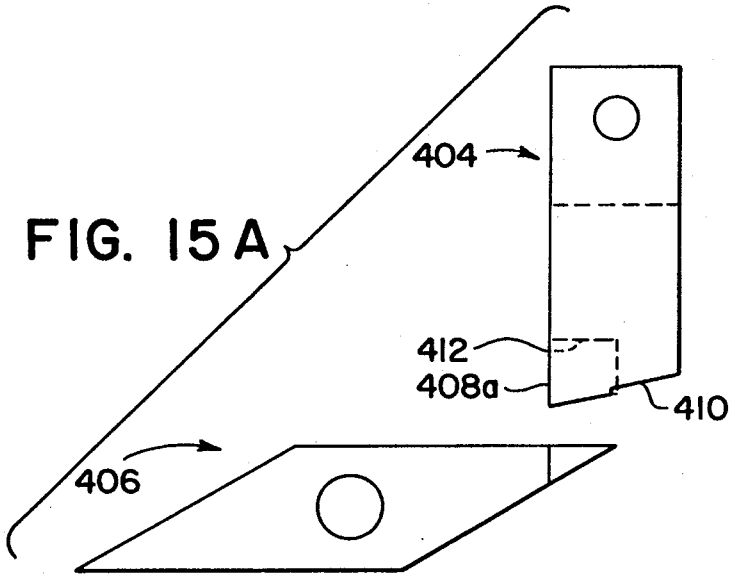
Figure 15B:
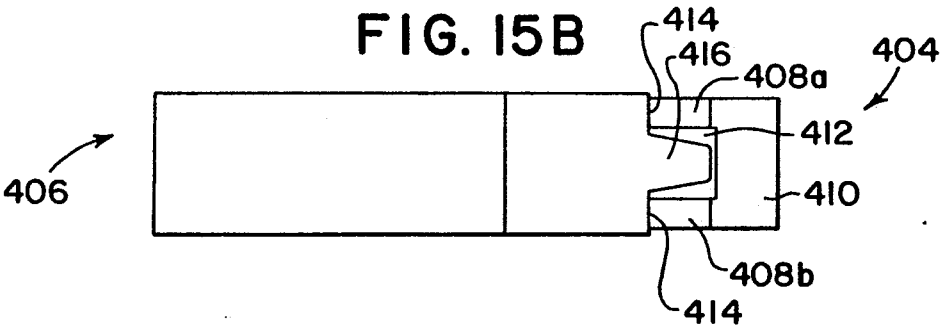

Referring to FIGS. 8*a* and 8*b*, an alternative cutting arrangement is illustrated. Referring first to FIG. 8*b*, a cut-off blade 86*b* and a cut-off knife 180*b* are shown. The knife 180*b* has a flat surface 234 and a bending/cutting edge 236. The blade 86*b* has a stepped bottom surface 238 having a width W matching a width w of the bending/cutting edge 236. Thus as the knife 180*b* moves in the direction 224, the lower surface 238 comes into contact with the band 13 beyond the buckle 15. The band 13 is forced into the width w of the blade 86*b* by the bottom surface 238. When the shoulders 240 of the knife 180*b* come into contact with the extensions 242 of the blade 86*b*, the band 13 has been bent and severed into a tab 244 as shown in FIG. 8*a*. Thus the tab 244 is formed with a straight cut-off edge 246 and a pair of retention ears 248. The retention ears 248 help secure the band 13 to the buckle 15 to prevent loss of tension therein.

Since it is important to the convenient use of the tool 10 to be able to tension the clamp 12 proximate the couple 14, the width of the tool 10 has been designed to be as close to the width of the band 13 as possible. Thus it is possible to place the tool 10 against the flange 18 and have the clamp 12 installed with a minimum amount of space therebetween. Similarly, the tool 10 has been designed for ease of operation by using the lever 44 rather than toggles as is found in the prior art. Finally, the angular relationship between the tensioning assembly and the head 36 provides a tool that is easy to load and that applies more of the work force to tensioning the band 13 than in previous devices.

FIGS. 9–12 illustrate various embodiments of a lock for use with a band clamp in which the lock provides improved strength characteristics relative to known locks in which the lock is formed by bending the band portion of the band clamp to create a locking surface that engages an exterior surface of a buckle portion of the band clamp.

In order to describe the lock of the present invention, it is believed to be useful to first describe the band clamp with which the lock is employed. With reference to FIGS. 9–12, the band clamp 300 includes a buckle 302 and a band 304 with a first end 306 that is operatively attached to the buckle 302 and a second end 308 that can be wrapped about an object and then engaged to the buckle 302. The band 304 is further defined by a first lateral edge 310*a* that is substantially parallel to a second lateral edge 310*b*. A longitudinal axis 312 extends from the first end 306 to the second end 308 and is substantially perpendicular to a line extending from a first point on the first lateral edge 310*a* to second point on the second lateral edge 310*b* that is the same distance from the first end 306 or the second end 308 as the first point. The band 304 further includes a first face 314*a* that is substantially parallel to a second face 314*b*. The band 304 is made of a material that can be wrapped about an object and then bent, deformed or otherwise processed to lock the band 304 to the buckle 302. Typically, the band 304 is made from a metal material, such as steel or aluminum. However, other materials, such as plastic, can also be used.

The buckle 302 can be generally described as an open-ended sleeve-like structure with a lower member 318 that is positioned substantially adjacent to the object about which the band 304 is wrapped and an upper member 320 that is separated from the object of interest by the lower member 318. The lower member 318 and the upper member 320 define an interior surface 322 that, in turn, defines a passageway 324 for receiving the band 304 after it has been wrapped about an object. The lower member 318 and the upper member 320 also define an exterior surface that includes an exterior side surface 326, a first exterior end surface 328*a*, and a second exterior end surface 328*b*. The buckle 302, like the band 304, is typically made of a metal material, such as steel or aluminum, but other materials, such as plastic, can also be employed.

Having described the band clamp 300, the lock of the present invention is now described with reference to FIGS. 9–12. Characteristic of each embodiment of the lock is that a lateral cross-section of a locking surface 332 that is established in a portion of the second end 308 of the band 304 that emerges from the buckle 302 after the band 304 has been passed through the passageway 324 is that a first point 336 on the first lateral edge 310*a* is a different distance from the lower member 318 of the buckle 302 than an intermediate point 338 on the band 304 that is located in between the first point 336 and a second point 340 on the second lateral edge 310*b*. The locking surface 332 engages the first exterior end surface 328*a* of the buckle 302 to prevent the band 304 from being pulled back through the passageway 324 of the buckle 302 as well as exhibits improved strength characteristics relative to known band clamp locks in which the band is bent, deformed, or otherwise processed to create a locking surface that engages the exterior of a buckle.

FIGS. 9*a*–9*d* and 10*a*–10*d* illustrate two embodiments of the lock of the present invention. In these embodiments of the lock, the lateral cross-section of the locking surface 332 has a first point 336 on the first lateral edge 310*a* which is greater distance from the lower member 318 of the buckle 302 than the intermediate point 338 on the band 304 that is located in between the first point 336 and the second point 340 on the second lateral edge 310*b*. These embodiments of the lock can be further characterized in that the second point 340 on the second lateral edge 310*b* is a greater distance from the lower member 318 of the buckle 302 than the intermediate point 338 on the band 304. Further, the distance of the first point 336 on the first lateral edge 310*a* to the lower member 318 of the buckle 302 and the distance of the second point 340 on the second lateral edge 310*b* to the lower member 318 of the buckle 302 are substantially equal.

Further, in these embodiments of the lock, the locking surface 332 comprises a first inner edge 344 and a second inner edge 346 which are formed by cutting portions of the band that emerge from the buckle 302 after the band 304 has been passed through the passageway 324. Particularly, the first inner edge 344 is a surface intermediate to the first face 314*a* and the second face 314*b* and is formed by cutting the band 304 traverse to the longitudinal axis 312 from a first cutting point 350*a* on the first lateral edge 310*a* to a first intermediate cutting point 350*b*. The second inner edge 346 is a surface intermediate to the first face 314*a* and second face 314*b* and is formed by cutting the band 304 traverse to the longitudinal axis 312 from a second cutting point 352*a* on the second lateral edge 310*b*, which is substantially opposite to the first cutting point 350*a*, to a second intermediate cutting point 352*b*. The locking surface 332 is formed by bending deforming or otherwise processing the first lateral edge 310*a* and second lateral edge 310*b*. The lock is established by engaging the first inner edge 344 and the second inner edge 346 of the locking surface 332 and the first exterior end surface 328*a* of the buckle 302.

Referring to FIGS. 9*a*–9*d*, this embodiment of the lock is further characterized by the lateral cross-section of the locking surface 332 being substantially V-shaped. It is a further characteristic of this embodiment of the lock that the band 304 has a second end 308 which comprises a point 354 where a first angled edge 356*a* and a second angled edge 356*b* merge. Particularly, when the first lateral edge 310*a* and second lateral edge 310*b* are being bent, deformed or otherwise processed to form the locking surface 332, the second end 308 of the band 304 is cut inwardly at an angle from the first lateral edge 310*a* to form a first inward angled edge 356*a* and from the second lateral edge 310*b* to form a second inward angled edge 356*b*. The first angled edge 356*a* and the second angled edge 356*b* of the band 304 beginning where the first lateral edge 310*a* and second lateral edge 310*b* end, respectively. Formed this way, the force required to sever the excess portion of the second end 308 of the band 304 is substantially reduced and as a result can be readily formed by a hand banding tool as well as a powered banding tool.

Referring to FIGS. 10*a*–10*d*, this embodiment of the lock is further characterized by the lateral cross-section of the locking surface 332 being substantially U-shaped. Consequently, the locking surface 332 is established by bending the first and second lateral edges 310*a*, 310*b* substantially parallel to the longitudinal axis 312. To ruin this embodiment of the lock would require the first lateral edge 310*a* and the second lateral edge 310*b* to be defeated along their entire length. The consequence being that this embodiment of lock, in addition to exhibiting the improved strength characteristics shown by the various embodiments of the present invention, also has generally long lasting qualities.

FIGS. 11*a*–11*d* and 12*a*–12*d* illustrate two embodiments of the lock of the present invention. In these embodiments of the lock, the lateral cross-section of the locking surface 332 is such that the intermediate point 338 that is located in between the first point 336 on the first lateral edge 310*a* and the second point 340 on the second lateral edge 310*b* is a greater distance from the lower member 318 of the buckle 302 than the first point 336 on the first lateral edge 310*a*. Further, the intermediate point 338 on the band 304 is a greater distance from the lower member 318 of the buckle 302 than the second point 340 on the second lateral edge 310*b*. In addition, the locking surface 332 is further characterized by the distance of the first point 336 on the first lateral edge 310*a* to the lower member 318 of the buckle 302 and the distance of the second point 340 on the second lateral edge 310*b* to the lower member 318 of the buckle 302 being substantially equal. Further, the locking surface is established by bending the first and second lateral edges 310*a*, 310*b* substantially parallel to the longitudinal axis 312 of the band 304.

Further, in these embodiments of the lock, the locking surface 332 comprises an intermediate edge 360 which is formed by cutting an intermediate portion 334 of the band 304 that emerges from the buckle 302 after the band 304 has been passed through the passageway 324. Particularly, the intermediate edge 360 is a surface intermediate to the first face 314*a* and the second face 314*b* of the band 304 and is formed by cutting the band 304 traverse to the longitudinal axis 312 from a first internal cutting point 362*a* to a second internal cutting point 362*b*, which is substantially opposite to the first internal cutting point 362*a* relative to the longitudinal axis 312. The locking surface 332 is formed by bending, deforming or otherwise processing the intermediate edge 360. The lock is established by engaging the intermediate edge 360 and the first exterior end surface 328*a* of the buckle 302.

These embodiments of the lock can be further characterized by the lateral cross-section of the locking surface 332 being substantially Ω-shaped. Further, the intermediate edge 360 is substantially even with upper member 320 of the buckle 302. In addition to exhibiting strength characteristics, these embodiments are formed in such a way to reduce the probability that the integrity of the lock will be compromised. Particularly, in these embodiments of the lock, the exposed edges are reduced to reduce the chances that the lock will defeated because of snagging. An additional advantage of these embodiments of the lock is that, due to the surface in between the first and second lateral edges 310*a*, 310*b* being displaced relative to the lower member 318 of the buckle 302 rather than the first and second lateral edges 310*a*, 310*b*, it allows a banding tool to be designed which can be used to form the lock for various band and buckle widths.

With reference to FIGS. 12*a*–12*d*, in this embodiment of the lock, the exterior surface of the buckle 302 that engages the locking surface 334 further comprises a lock cover 366 to protect the locking surface 334 against tampering. The lock cover 366 comprises a cover exterior surface 368, a cover interior surface 370, a first cover end surface 372 and a second cover end surface 374, a first cover side surface 376, and a second cover side surface 378. Particularly, the lock cover 366 extends from the upper member 320 and over the portion of the band 304 that emerges from the buckle 302 after the band 304 has been passed through the passageway 324. The lateral cross-section of the lock cover 366 is substantially similar to the lateral cross-section of the locking surface 332 being covered. In this embodiment of the lock, the lateral cross-section of the cover exterior surface 368 is substantially Ω-shaped.

In addition to providing protection for the lock, the lock cover 366 provides a reference point for the banding tool that is used to form the lock. Particularly, when the locking surface 332 is formed, the intermediate edge 360 of the locking surface 334 conforms with the cover interior surface 370 of the lock cover 366. The lock is established by engaging the intermediate edge 360 of the locking surface 334 and the portion of the first exterior end surface 328*a* of the buckle 302 which is left exposed by the lock cover 366.

Having described the various embodiments of the lock of the present invention, the method of forming the various embodiments of the lock illustrated in FIGS. 9–12 and the tools for forming these locks will now be described. It is a characteristic of each embodiment of the lock that the locking surface 332 is established by shaping the portion of the second end 308 of the band 304 that emerges from the buckle 302 after being passed through the passageway 324, so that if the locking surface 332 is viewed in a lateral cross-section, the first point 336 on the first lateral edge 310*a* is a different distance from the lower member 318 of the buckle 302 than the intermediate point 338 located in between the first point 336 and the second point 340 on the second lateral edge 310*b*. The locking surface 332 can then engage the first exterior end surface 328*a* of the buckle 302 to prevent the band 304 from being pulled back through the passageway 324 of the buckle 302 as well as exhibits improved strength characteristics relative to known band clamp locks in which the band is shaped to create a locking surface that engages the exterior of the buckle.

As discussed earlier, FIGS. 9*a*–9*d* and 10*a*–10*d* illustrate two embodiments of the lock of the present invention. In these embodiments of the lock, the locking surface 332 is formed by shaping the portion of the second end 308 of the band 304 that emerges from the buckle 302 after the band 304 has passed through the passageway 324 so that if the locking surface 332 is viewed in lateral cross-section, the first point 336 on the first lateral edge 310*a* is a greater distance from the lower member 318 of the buckle 302 than the intermediate point 338 on the band 304; the second point 340 on the second lateral edge 310*b* is also a greater distance from the lower member 318 of the buckle 302 than the intermediate point 338; and the distances between the first point 336 and the lower member 318 and between the second point 340 and the lower member 318 of the buckle 302 are substantially equal.

Referring to FIGS. 9*a*–9*d*, this embodiment of the lock is further characterized by shaping the portion of the second end 308 of the band 304 that emerges from the buckle 302 so that the lateral cross-section of the locking surface 332 is substantially V-shaped in accordance with the method previously discussed. The forming of the locking surface 332 also includes cutting the second end 308 of the band 304 from the first cutting point 350*a* to the first intermediate cutting point 350*b* and from the second cutting point 352*a* to the second intermediate cutting point 352*b* to form a first cut and a second cut respectively, in the band 304. These cuts facilitate bending the band 304 to establish the aforementioned V-shape as well as establish the first inner edge 344 and the second inner edge 346 that contact the first exterior end surface 328 of the buckle 302. Additionally, the second end 308 of the band 304 is cut to trim the excess portion the second end 308. Specifically, the second end 308 is cut at an angle or along a curve from the first lateral edge 310*a* to form the first angled edge 356*a* and from the second lateral edge 310*b* to form the second angled edge 356*b*. By trimming the second end 308 in this way, a tool can be designed that permits the cut or cuts to be made over a defined period of time rather than simultaneously. As a result, less force per unit of time is needed to make the cut or cuts thereby allowing implementation in a hand tool as well as a powered tool.

One way to form the embodiment of the lock referred to in FIGS. 9*a*–9*d* is to use the banding tool previously described with a V-blade 382 and a V-knife 384. The V-blade 382 includes a curved edge 386, a first leg 388*a*, a second leg 388*b*, and a buckle contact surface 389 that cooperate with the V-knife 384 to form the locking surface 332. Likewise, the V-knife 384 includes first angled straight edge 390*a*, second angled straight edge 390*b*, first curved edge 392*a*, and second curved edge 392*b* for cooperating with the edges and surfaces of the blade 382 to produce the locking surface 332 and to sever the excess portion of the band 304.

With the V-blade 382 and V-knife 384 installed in the tool and the second end 308 of the band 304 being appropriately tensioned by the tool, formation of the locking surface 332 commences with the V-knife 384 being displaced toward the V-blade 382 by the movement of the cut-off handle 154. As the V-knife is displaced the buckle contact surface 389 comes into contact with the upper member 320 of the buckle 302. Likewise, the first angled straight edge 390*a* and the second angled straight edge 390*b* come into contact with the first face 314*a* of the band 304. With contact established, the V-knife 382 is now further displaced toward the V-blade 384 to establish the locking surface 332 and to sever the excess portion of the second end 308 of the band. Specifically, further displacement of the V-knife 384 results in the first and second angled straight edges 390*a*, 390*b* of the V-knife 384 cooperating with the first and second legs 388*a*, 388*b* of the V-blade 382 to bend the first lateral edge 310*a* and second lateral edge 310*b* of the band 304 away from the lower member 318 of the buckle 302 in the characteristic V-shape. Also as a result, the band 304 immediately adjacent to the first exterior end surface 328a of the buckle 302 is cut from the first cutting point 350a on the first lateral edge 310a to the first intermediate cutting point 350b and from the second cutting point 352a on the second lateral edge 310b to the second intermediate cutting point 352b to form the first inner edge 344 and the second inner edge 346 of the locking surface 332, respectively. These cuts are caused by the bending of the band 304 forcing the first face 314a of the band 302 into contact with the portion of the first exterior end surface 328a associated with the upper member 320 of the buckle 302. The surface is hereinafter referred to as the band cutting edge 396. The lock is now formed by the engagement of the locking surface 332 to the buckle 302 and, more specifically, by the engagement between the first inner edge 344 and the second inner edge 346 of the locking surface 332 with the first exterior end surface 328a of the buckle 302.

After formation of the locking surface 332, the band 304 is cut to form a first angled edge 356a and a second angled edge 356b, which terminate into a point 354, by the opposition of first and second curved edges 392a, 392b of the V-knife 384 against the curved edge 386 of the V-blade 384. Due to the curve of the first and second curved edges 392a, 392b, the cuts required to form the first and second angled edges occur over a period of time rather than simultaneously. Consequently, the force required to sever the excess portion of the second end 308 of the band 304 is substantially reduced and as a result can be readily accomplished with the hand banding tool as well as a powered banding tool. Further, the lock is established while avoiding a release of tension in the band and relative rotation between the band and the clamped object together with the thinning that is associated with this rotation.

Referring to FIGS. 10a–10d, this embodiment of the lock is further characterized by shaping the portion of the second end 308 of the band 304 that emerges from the buckle 302 so that the lateral cross-section of the locking surface 332 is substantially U-shaped in accordance with the method previously discussed. The forming or shaping of the locking surface 332 also includes cutting the band 304 from the first cutting point 350a to the first intermediate cutting point 350b and from the second cutting point 352a to the second intermediate cutting point 352b to form a first cut and a second cut, respectively, in the band 304 that facilitate the bending of the first and second lateral edge 310a, 310b the band 304 substantially parallel to the longitudinal axis 312 to achieve the U-shape characteristic of this particular embodiment of the lock. Further, the cuts establish the first inner edge 344 and second inner edge 346 that engage the first exterior end surface 328 of the buckle 302. Also, in conjunction with forming the locking surface 332, the second end 308 of the band 304 is trimmed.

One way to form the embodiment of the lock referred to in FIGS. 10a–10d is to use the banding tool with the cut-off blade 86b and cut-off knife 180b previously described. To reiterate, as the cut-off knife 180b is pushed in the direction 224 by the movement of the cut-off handle 154, a buckle contact surface 400 of the cut-off knife 180b contacts the upper member 320 of the buckle 302. Further, the lower surface 238 of the cut-off knife 180b comes into contact with the first face 314a of the band 304. After contact is established, the cut-off knife 180b is now further displaced towards the cut-off blade 86b to form the locking surface 332 and to trim the excess portion of the second end 308 of the band 304. Specifically, further displacement of the cut-off knife 180b results in the lower surface 238 cooperating with the extensions 242 of the cut-off blade 86b to bend the first lateral edge 310a and second lateral edge 310b of the band 304 away from the lower member 318 of the buckle 302 to form the characteristic U-shape of the lock. Also, as a result, the band 304 immediately adjacent to the first exterior end surface 328a of the buckle 302 is cut from the first cutting point 350a on the first lateral edge 310a to the first intermediate cutting point 350b and from the second cutting point 352a on the second lateral edge 310b to the second intermediate cutting point 352b to form the first inner edge 344 and the second inner edge 346 of the locking surface 332, respectively. These cuts are caused by the bending of the portion of the band 304 forcing the first face 314a of the band 304 into contact with the band cutting edge 316. The lock is now formed by the engagement of the locking surface 332 to the buckle 302 and, more specifically by the engagement of the first inner edge 334 and the second inner edge 346 of the locking surface 332 with the first exterior end surface 328a of the buckle 302. It should also be noted that the lock is established while substantially avoiding the release of tension in the band and relative rotation of the band and the clamped object together with the thinning resulting from rotation.

FIGS. 11a–11d and 12a–12d illustrate two embodiments of the lock of the present invention. In these embodiments of the lock, the locking surface 332 is formed by shaping the portion of the second end 308 of the band 304 that emerges from the buckle 302 so that if the locking surface 332 is viewed in lateral cross-section, the intermediate point 338 on the band 304 is a greater distance from the lower member 318 of the buckle 302 than the first point 336 and the second point 340. Further, in the lateral cross-section, the distance of the first point 336 on the first lateral edge 310a from the lower member 318 of the buckle 302 and the distance of the second point 34 from the lower member 318 are substantially equal. Stated another way, the lateral cross-section of the locking surface 332 is substantially Omega-shaped. Further, the portion of the band 304 is bent, deformed or otherwise processed to cause the intermediate edge 360 to be substantially even with the upper member 320 of the buckle 302. As before, the lock is created in a manner that largely circumvents any need to release tension in the band and relative rotation between the band and the clamped object and the thinning due to rotation.

One way to form the embodiment of the lock referred to in FIGS. 11a–11d is to use the Ω-knife 404 and Ω-blade 406 shown in FIGS. 15a–15d with the banding tool previously described. The Ω-knife 404 includes a first leg 408a, a second leg 408b, a buckle contact surface 410, band contact surface 412, and a first cutting edge 414 for cooperating with the Ω-blade 406 to produce the lock and sever excess band. The Ω-blade 406 includes a tongue 416 and a second cutting edge 418 for cooperating with the Ω-knife 404 to form the lock and trim any excess portion of the band 304.

With the Ω-knife 404 and Ω-blade 406 installed in the tool and with the band 304 appropriately tensioned by the tool, formation of the locking surface 332 commences with the Ω-knife 404 being displaced towards the Ω-blade 406 by the movement of the cut-off handle 154. As the Ω-knife 404 is displaced, the buckle contact surface comes into contact with the upper member 320 of the buckle 302 and the first and second legs 408*a*, 408*b* come into contact with the band 304. Further displacement of the Ω-knife 404 towards the Ω-blade 406 serves to form the locking surface 332 and sever any excess portion of the band 304. Specifically, further displacement of the Ω-knife 404 results in the first and second legs 408*a*, 408*b* of the Ω-knife 404 cooperating with the tongue 416 to form the locking surface 332 by displacing the portion of the band 304 located intermediate the first and second lateral edges 310*a*, 310*b* to be bent away from the lower member 318 of the buckle 302 in the characteristic Ω-shape. Also as a result of the bending the portion of the band 304 immediately adjacent to the first exterior end surface 328*a* of the buckle 302 is cut from the first internal cutting point 362*a* to the second internal cutting point 362*b* to form the intermediate edge 360. This cut is caused by the bending of this portion of the band 304 forcing the first face 314*a* of the band 304 to contact the band cutting edge 396. The band cutting edge 396 is the interface of the interior surface 322 and upper member 320 of the buckle 302. The lock is now formed by the engagement of the locking surface 332 to the buckle 302 and more specifically, by the engagement between the intermediate edge 360 of the locking surface 332 and the first exterior end surface 328*a* of the buckle 302.

One way to form the embodiment of the lock referred to in FIGS. 12*a*–12*d* is to use, in the previously described banding tool, the Ω-knife 404 and Ω-blade 406 shown in FIGS. 15*a*–15*d* with the appropriate modifications to accommodate the lock cover 366. Particularly, the Ω-knife 404 is modified so that it substantially corresponds to the cross-sectional shape of the lock cover 366. When in operation the Ω-knife contacts the lock cover 366 as well as the upper member 320 of the buckle 302. In all other respects the use of the Ω-knife 404 and Ω-blade 406 in the banding tool to form the lock illustrated in FIGS. 12*a*–12*d* is identical to that previously described for forming the lock shown in FIGS. 11*a*–11*d*. Also, the lock is made in a fashion that largely circumvents the need to release tension in the band and relative rotation between the band and the clamped object and hence the thinning associated with rotation.

Although the present invention has been described with respect to a specific preferred embodiment thereof, various changes and modifications may be suggested to one skilled in the art and it is intended that the present invention encompass such changes and modifications as fall within the scope of the appended claims.

What is claimed is:

1. A method for forming an improved lock for securing a band to a buckle, comprising:

providing a buckle having a lower surface for positioning substantially adjacent to an object, an upper surface that is separated from said lower surface, said lower surface and said upper surface defining a longitudinally extending passageway for receiving a band and an exterior surface, said passageway having an entrance and an exit;

providing a band having a first end that is operatively connected to said buckle, a second end for wrapping about said object, a first lateral edge, and a second lateral edge;

wherein said band has a longitudinal axis that extends from said first end to said second end;

wherein said first lateral edge has a first point and said second edge has a second point that is substantially opposite to said first point relative to said longitudinal axis;

wherein a section of said band is located intermediate to said first point and said second point;

wrapping said second end of said band about said object;

inserting said second end of said band into said entrance of said passageway of said buckle so that a portion of said second end that includes said first point, said second point, and said section extends past said exit of said passageway; and bending said portion of said second end of said bend at a location exterior to said exit to form a surface for forming a locking engagement with said exterior surface of said buckle, wherein said first point of said first lateral edge is a first distance from said lower surface of said buckle, said second point is a second distance from said lower surface of said buckle, and said section of said band located intermediate to said first point and said second point is located a third distance from said lower surface of said buckle that is different than said first distance.

2. A method, as claimed in claim 1, wherein:

said first distance is substantially equal to said second distance.

3. A method, as claimed in claim 1, wherein:

said first distance is substantially equal to said second distance and both said first distance and said second distance are greater than said third distance.

4. A method, as claimed in claim 1, wherein:

said first distance is substantially equal to said second distance and both said first distance and said second distance are less than said third distance.

5. A method, as claimed in claim 1, wherein:

said step of bending produces a bend that extends in a direction that is other than parallel to said longitudinal axis of said band.

6. A method, as claimed in claim 1, wherein:

said step of bending produces a bend that is substantially parallel to said longitudinal axis of said band.

7. A method, as claimed in claim 1, wherein:

said step of bending includes cutting said portion of said second end of said band to produce a curved edge.

8. A method, as claimed in claim 1, wherein:

said step of bending includes cutting said portion of said second end of said band to produce a curved edge, wherein said step of cutting occurs over a defined period of time rather than simultaneously.

9. A method, as claimed in claim 1, wherein:

said step of bending includes cutting a portion of said band to produce a cut that begins at a first location and terminates at a second location, wherein said first location and said second location are located in between said first lateral edge and said second lateral edge.

10. A method, as claimed in claim 1, wherein:

said step of bending includes making two cuts in said portion of said second end of said band.

11. A method as claimed in claim 1, wherein:

said step of bending includes making a first cut and a second cut in said portion of second end of said band, said first cut beginning at said first lateral edge and terminating at a first location that is in between said first lateral edge and said second lateral edge, said second cut beginning at said second lateral edge and terminating at a second location that is in between said first lateral edge and said second lateral edge.

12. A method, as claimed in claim 1, wherein:

said step of bending includes using a portion of said buckle that is adjacent to said second end of said band to cut a portion of said band.

13. A method for establishing a lock between a band and a buckle, comprising:

providing a buckle having a longitudinally extending passageway for receiving a band, said passageway having an entrance and an exit, said exit defined by an edge of said buckle;

providing a band having a first lateral edge, a second lateral edge, a first end operatively attached to said buckle, and a second end for wrapping about an object and inserting into said passageway;

wrapping said second end of said band about said object;

inserting said second end of said band through said passageway so that at least a portion of said second end of said band extends beyond said exit; and cutting said portion of said second end of said band that extends beyond said exit of said buckle to form a cut so that a lock can be formed between said band and said buckle, said cut beginning at said first lateral edge and ending at a point located in between said first lateral edge and said second lateral edge.

14. A method for establishing a lock between a band and a buckle, comprising:

providing a buckle having a longitudinally extending passageway for receiving a band, said passageway having an entrance and an exit, said exit defined by an edge of said buckle;

providing a band having a first lateral edge, a second lateral edge, a first end operatively attached to said buckle, and a second end for wrapping about an object and inserting into said passageway;

wrapping said second end of said band about said object;

inserting said second end of said band through said passageway so that at least a portion of said second end extends beyond said exit; and cutting said portion of said second end of said band that extends beyond said exit of said buckle to form a cut so that a lock can be formed between said band and said buckle, said cut includes a first cut and a second cut, wherein said first cut begins at said first lateral edge and terminates at a point located in between said first lateral edge and said second lateral edge, wherein said second cut begins at said second lateral edge and terminates at a point located in between said first lateral edge and said second lateral edge.

15. A method for establishing a lock between a band and a buckle, comprising:

providing a buckle having a longitudinally extending passageway for receiving a band, said passageway having an entrance and an exit, said exit defined by an edge of said buckle;

providing a band having a first lateral edge, a second lateral edge, a first end operatively attached to said buckle, and a second end for wrapping about an object and inserting into said passageway;

wrapping said second end of said band about said object;

inserting said second end of said band through said passageway so that at least a portion of said second end extends beyond said exit; and cutting said portion of said second end of said band that extends beyond said exit of said buckle to form a cut so that a lock can be formed between said band and said buckle, said cut begins at a first point that is located in between said first lateral edge and said second lateral edge and terminates at a second point that is different than said first point and is located in between said first lateral edge and said second lateral edge.

* * * * *